United States Patent [19]

Field et al.

[11] Patent Number: 4,666,341

[45] Date of Patent: May 19, 1987

[54] MOBILE SEA BARGE AND PLATEFORM

[75] Inventors: Almeron J. Field, Los Angeles; Gerald L. Johnson; Daniel G. Whyte, both of Orange, all of Calif.

[73] Assignee: Santa Fe International Corporation, Alhambra, Calif.

[21] Appl. No.: 817,679

[22] Filed: Jan. 8, 1986

Related U.S. Application Data

[63] Continuation-in-part of Ser. No. 516,371, Jul. 22, 1983.

[51] Int. Cl.[4] ..... E02B 17/00

[52] U.S. Cl. ..... 405/217; 114/40; 405/195; 405/203

[58] Field of Search ..... 405/203, 204, 207, 208, 405/195, 217; 114/264, 265, 40

[56] References Cited

U.S. PATENT DOCUMENTS

| | | | |
|---|---|---|---|
| 2,086,367 | 4/1963 | Foster . | |
| 2,248,051 | 7/1941 | Armstrong | 405/208 |
| 2,289,301 | 7/1959 | Casagrande et al. | 405/208 |
| 2,873,581 | 2/1959 | Hazak | 405/205 |
| 2,946,198 | 7/1960 | Knapp | 405/208 |
| 2,946,566 | 7/1960 | Samuelson | 405/208 |
| 2,953,904 | 9/1960 | Christenson . | |
| 3,001,370 | 9/1961 | Templeton | 114/265 X |
| 3,013,396 | 12/1961 | Suderow | 405/208 |
| 3,294,051 | 12/1966 | Khelstovsky | 114/265 |
| 3,515,084 | 6/1970 | Holmes | 114/264 |
| 3,708,991 | 1/1973 | Barkley | 114/265 X |
| 3,831,385 | 8/1974 | Hudson et al. . | |
| 3,872,679 | 3/1975 | Fischer . | |
| 3,927,535 | 12/1975 | Giblon | 405/203 |
| 3,952,527 | 4/1976 | Vineratos et al. . | |
| 3,996,754 | 12/1976 | Lowery . | |
| 4,037,424 | 7/1977 | Anders . | |
| 4,048,943 | 9/1977 | Gerwick . | |
| 4,080,796 | 3/1978 | Edling et al. . | |
| 4,108,102 | 8/1978 | Lindstrom | 114/264 |
| 4,142,819 | 3/1979 | Challine et al. . | |
| 4,222,683 | 9/1980 | Vilian . | |
| 4,265,568 | 5/1981 | Herrmann et al. . | |
| 4,314,776 | 2/1982 | Palmer et al. | 405/203 |
| 4,451,174 | 5/1984 | Wetmore | 405/203 X |
| 4,468,152 | 8/1984 | Lamy et al. | 405/217 X |
| 4,578,000 | 3/1986 | Lindqvist et al. | 405/217 X |

OTHER PUBLICATIONS

Part 1—Fifty-One New Concepts for Arctic Drilling and Production by Buslav et al., Brown & Root, Inc., Ocean Industry, Aug. 83, pp. 46–52.

Conceptual Design for a Mobile Arctic Gravity Platform by Wasilewski et al., Gulf Canada Resources Inc., pp. 60–69.

Preliminary Design of the Arctic Mobile Structure, Port Ocean Engineering Under Arctic Corporation, Hancock et al., pp. 1191–1203.

Global Marine Designs Rigs for Arctic Work, Offshore Dec. 82, pp. 82–95.

*Primary Examiner*—Dennis L. Taylor

*Attorney, Agent, or Firm*—Harris, Kern, Wallen & Tinsley

[57] ABSTRACT

A mobile sea barge having a unitary lower hull which has sufficient buoyancy to float the entire barge, an upper hull spaced from the lower hull by a single, centrally-positioned, vertical member, and a movable stabilizing hull arranged about the central support member for controlled movement between the upper and lower hulls is provided. Controlled movement of the stabilizing hull permits the operational modes of submerging and emerging of the lower hull into or from a bottom-founded gravity-forced mode from which drilling operations can be carried out. In the bottom-founded mode on the sea floor the barge functions as a gravity platform. Movement of the stabilizing hull is provided by a plurality of jacking legs and jacking units which constitute the control devices. The barge can be quickly switched between the surface-floating and the gravity-forced, bottom-founded modes. Controlled vertical descent to the sea floor is provided by the static stability of the stabilizing hull. The jacking legs, which are preferably four in number, are under compressive force during the submerging and the emerging modes of operation. The vertically movable stabilizing hull may be used to fail ice features by exerting downward pressure on the ice between the upper and lower hulls and by positioning the stabilizing hull adjacent the waterline for engaging ice floes to fail the floes in flexure.

20 Claims, 18 Drawing Figures

FORWARD

F WIND
F ICE
$M_{EL}$
D/2
W
X
Y

MOBILE SEA BARGE AND PLATEFORM

CROSS-REFERENCE TO RELATED APPLICATION

This application is a continuation-in part of copending application U.S. Ser. No. 06/516,371, filed 22 July 1983.

BACKGROUND OF THE INVENTION

The present invention relates to a seagoing barge having a physical configuration and operative means which permit the barge to be partially submerged into bottom-supported gravity contact with the sea floor. More specifically, it relates to a barge and platform construction which can be submerged in a stable vertical path onto the sea floor.

The term "barge" as employed herein means a vessel which is capable of providing buoyancy for surface-floating transit as a first operational mode. The term "platform" is intended to mean a structure which rests on the sea floor and has a portion thereof elevated above the water surface. The barge disclosed herein has a surface-floating transit mode and a bottom-resting fixed position mode of operation.

Barges and platforms of the type above-referred-to are used for offshore oil exploration and production drilling purposes. When the barge/platform is to be utilized in benign sea areas a wide variety of platform configurations and erection techniques can be employed since low wave heights and ice-free weather conditions prevail. The barge/platform of the present invention can be used in such benign sea areas but can also be used in harsh sea areas such as those encountered in the arctic and antarctic latitudes.

When a barge/platform is to be used in arctic conditions such as those encountered in the Beaufort Sea, the Chukchi Sea, or the Bering Sea, specialized barge/platform designs must be employed. In many parts of the arctic latitudes the seas are generally covered with ice from October through June. A landfast ice cover begins to form in early October and grows seaward reaching a maximum thickness of approximately seven feet by May. Break-up usually begins in early June and continues throughout the remainder of the summer. This landfast ice consists of two distinct zones. The first zone extends about 15 miles outwardly from the shore to a water depth of about 33 feet. This zone usually consists of smooth first-year ice with a maximum thickness of seven feet. The second zone covers a water depth range of 33 to about 66 feet and contains a number of first-year pressure ridges. On some occasions, the ice in the second zone contains multi-year ice floes that are more consolidated than the first-year ice. Beyond the second zone and out to a position just past the Continental Shelf, at water depths exceeding 200 feet, is the transition zone which contains large pressure ridges that move around in sporadic motion. Beyond this zone is the permanent polar ice pack which is composed primarily of multi-year ice. This description of ice conditions holds particularly for the south part of the Beaufort Sea between Harrison Bay and the Prudhoe Bay.

Another environmental condition encountered in the Beaufort Sea area is that the sea floor consists mainly of pleistocene clays and holocene silts which have low force-bearing properties. As a result of this soft sea floor, some oil production equipment such as the well cap valve and tube systems known as "Christmas trees" have been known to sink into and disappear in the silt unless adequately buoyed.

The combination of ice floes on the surface of the sea and soft, low force-bearing, sea floor soil conditions presents special problems for barge/platform design and operations. The first problem is that the ice floes impact any support member extending through the water surface and this, in turn tends to push the entire platform off of its drilling location. The force of the ice floe has been calculated to be sufficient to move a large multiton platform. Due to the soft sea floor soil conditions such platforms cannot be adequately secured to the sea floor by piles or other economically feasible means. One suggested offshore structure in U.S. Pat. No. 4,048,943 to Gerwick is to employ a floating caisson which is maintained in position by mooring lines. In this structure, a cone-shaped surface is utilized as an ice breaking feature. However, many ice floes are sufficiently compact so that the mooring lines will break or the anchors will fail to hold before the ice floe is broken up by the conical surface.

Another form of barge/platform is shown in U.S. Pat. No. 4,080,796 which includes a ring shaped mat which is lowered into contact with the sea floor by the downward movement of three support legs. This vessel construction has two problems with respect to vessel operation. The first is that the ring-shaped bottom surface of the mat has an insufficient area of contact with clay and silt which are present on extensive areas of the sea floor to enable the development of large frictional contact so that the vessel will not be pushed off of location by the ice floes. This problem is accentuated because there are three support columns for contact with the ice floe. Thus, it is necessary in the operation of this platform to bury the ring-shaped mat below the sea floor in order to resist the lateral ice forces which develop overturning moments. Another problem is that the drilling operations must occur down through one of the support legs so that the drill string is not exposed to ice floes which are present beneath the upper hull. This requires then the placement of the drilling derrick over one of the legs which then creates an overturning moment about the center of the platform.

Barge/platform designs which utilize multiple support columns all encounter the problem of presenting multiple surfaces which would be impacted by ice floes in arctic seas such as described above. These designs have limited utility in such harsh sea conditions. Representative disclosures are shown in U.S. Pat. Nos. 2,873,581 to Hazak; 2,895,301 to Casagrande et al.; 2,953,904 to Christenson; 3,872,679 to Fischer; and 3,001,370 to Templeton.

Another type of offshore structure is set forth in representative U.S. Pat. Nos. 3,831,385 to Hudson et al.; 3,952,527 to Vinieratos et al.; 4,037,424 to Anders and 4,314,776 to Palmer et al. which shows bottom resting platforms which penetrate the water surface. These structures are very large and heavy and either do not have the necessary buoyancy for towing or only tow very poorly. These are not then barges. Also, difficulties are encountered in placing these structures at the drilling site. The difficulties arise due to two separate problems. The first is that, even when such structures are provided with sufficient buoyancy to float, the large volume of the structure submersed in the water creates high towing resistance. A second problem is that when the structure is submerged into bottom-resting contact with the sea floor the vessel can tilt and rapidly submerge into a bottom-contacting mode in which a large portion of the footing structure will submerge in the clay and silt sea floor. This will necessitate additional tug work for moving the structure to achieve a vertical attitude.

The problem of platform submergence at a high contact angle with the sea floor can be seen in U.S. Pat. No. 4,222,682 where container 1 and platform 111 are submerged from floating positions on the surface to sea floor contacting positions. If the sea floor is rocky and uneven, severe damage to the structures can occur from the high angle of impact shown in FIGS. 3, 14, and 15 of this patent.

Some offshore structures, mainly known as jack-up platforms, are towed to a use site and the bottom footing flooded to send it to the sea floor, then the top deck is jacked up out of the wave action. U.S. Pat. Nos. 3,996,754 to Lowery and 4,265,568 to Herrmann et al. are representative of this type. In some units of this type large flotation shells have been provided as in U.S. Pat. No. 3,086,367 to Foster and 4,142,819 to Challine et al. Operating problems occur during use of these shells since these are often flexibly connected to the main structure of the units to provide for movement relative thereto, and wave action on such large shells causes the connecting gear to break and foul. The dynamic loading forces generated on these large offshore structures by wave action can exceed the design limits of the connecting gear.

Yet other offshore structures require extensive construction work in order to erect the same, which often necessitates the use of mobile crane barges such as shown in FIG. 8 of U.S. Pat. No. 3,927,535 to Giblon.

The mobile barge/platform of the present invention overcomes the above-described problems and provides a structure for offshore oil field development which has unique operational properties.

SUMMARY OF THE INVENTION

The mobile barge of the present invention is constructed with a unitary lower hull which has sufficient buoyancy to permit the entire barge to have a surface-floating operational mode. This lower hull configuration facilitates transit of the barge between drilling locations. The lower hull has a bottom surface adapted for providing gravity-forced contacting support from the sea floor when the barge is in a bottom-resting mode. An upper hull is spaced from the lower hull by a single, centrally-positioned, vertical member which is centrally mounted between the upper and lower hulls. The central support member may have various external shapes such as prismatic, in which case the exterior is formed by a series of planar sides; or non-prismatic, as in the case of a cylindrical exterior. The exterior surface of the central support member can also be straight-sided or sloped over all or part of its height. The upper hull is adapted to contain the majority of equipment necessary for conducting the barge operating functions such as a drilling derrick mud mixers and pumps; mud, cement and pipe storage areas; and day tanks. Also, crew accommodations, transportation, communication and power equipment are provided for.

A stabilizing hull is arranged about the central support member and is adapted for controlled movement between a position adjacent to the top surface of the lower hull to a position adjacent to the bottom surface of the upper hull. This controlled movement provides a third operational mode which entails submerging or emerging of the lower hull into or from the bottom-founded mode. A plurality of control devices can be connected to the stabilizing hull to provide for such movement. These devices can each be comprised of a jacking leg secured to the stabilizing hull and a separate motive means for moving the jacking leg relative to the upper and lower hulls. In this fashion, the control devices or means are adapted to operate simultaneously to move the stabilizing hull to various vertical positions between the upper and lower hulls. The specific motive means employed in the preferred form are a plurality of jacking units which are secured to the upper hull and which are in jacking contact with the legs. In this preferred form, the stabilizing hull is movably connected to the upper hull through four jacking legs equally spaced from the central axis of the central support member.

The combination of the stabilizing hull and the control means permits the mobile barge to be quickly switched between the surface-floating mode and the gravity-forced, bottom-founded mode. The translation between these two operational modes is reversible. Starting from a floating mode in which the barge buoyancy is provided by the displacement of the lower hull, a controlled descent of the lower hull onto the sea floor is possible in moderate wave heights. First, the barge is moored over the drilling site. Then selected compartments in the lower hull are ballasted. This ballasting is continued until the lower hull is submerged below the water surface with the water level near the mid-depth of the stabilizing hull, so that the stabilizing hull provides the waterplane area for static stability. At this draft the stabilizing hull exerts a net upward buoyancy force through the jacking legs which balances the net downward force of the other components of the barge. The motive force exerted by the jacking means on the respective jacking legs is thus a compressive force acting between the stabilizing hull and the upper hull. Lateral wave and wind forces which act on the stabilizing hull can be transmitted directly to the upper hull by the jacking legs or preferably transmitted to the support member by contact of the stabilizing hull therewith.

The inner dimension of the stabilizing hull is enough greater than the outer dimension of the central support member to permit free passage therealong. The horizontal force components exerted by wind and waves on the stabilizing hull can be transferred to the remainder of the barge through the jacking legs. If the support member is of a straight-sided configuration the inner surface of the stabilizing hull can be designed to be spaced close to the outer surface of the support member to enable horizontal forces to be transferred therebetween so that the size of the jacking legs can be kept to a minimum consistent with the vertical force transmission requirements.

Due to the large displacement mass of the submerged lower hull, including its added mass, the motion response of the barge is reduced to negligible amplitudes even in moderate seas of up to 5 feet significant height.

The controlled descent is accomplished by the jacking units which are operated to move the stabilizing hull upwardly toward the upper hull by small increments. The jacking legs are thus moved progressively upward through the upper hull. In this manner the lower hull can be founded in a controlled manner on the sea floor. The retaining ballast compartments in the lower hull are then flooded to increase the gravity-forced, bottom contact pressure. The stabilizing hull is then continued to be moved upward toward the under-surface of the upper hull. During this upward movement from the surface of the water the jacking legs are in tension. The stabilizing hull is then secured by locking the jacking units, and ballast compartments in this stabilizing hull can be then filled with sea water to increase the gravity weight of the barge.

The lift-off procedure is set forth in more detail below, but in general is a reverse sequence to that described herein.

An alternate jacking arrangement is that the jacking legs can be secured to both the upper and lower hull or only the latter hull when the barge is to operate in benign sea areas which are subject to only light ice floe conditions. In this configuration the jacking units are mounted inside the stabilizing hull rather than on the upper hull. The stabilizing hull is then moved between the upper and lower hulls in exactly the same manner as set forth herein for the preferred embodiment. It is, however, preferred to locate the jacking means on the upper surface of the upper hull so that the legs are secured to only the stabilizing hull whereby improved operations and ease of servicing are provided for.

The preferred embodiment has a sixteen-sided, polygon shaped lower hull, a cylindrical shaped stabilizing hull, and a rectangular shaped upper hull. The lower and upper hulls are connected by a circular, centrally-positioned, vertical support column. The lower hull and the stabilizing hull both have watertight bulkheads therein for establishing separate ballasting compartments. Required pumping equipment is also provided for ballasting and deballasting the compartments.

A drilling derrick is centrally positioned over the moon pool opening which is the upper end of the drilling shaft formed by the hollow support column. In this manner, drilling operations can take place under an enclosed or partially enclosed derrick and through the bottom of the barge/platform so that the crew and equipment are not exposed to arctic weather conditions.

A fourth operational mode is provided by the capability of the barge to be slid off its bottom-founded, gravity-forced location by a sufficiently high lateral force such as can be exerted by multi-year ice pressure ridges.

In yet another operational mode, the vertically movable stabilizing hull can be used for failing ice features as by moving the stabilizing hull downward onto an ice floe to exert pressure on ice between the upper and lower hulls and by positioning the stabilizing hull adjacent the waterline so as to engage ice floes and fail them in flexure.

The mobile barge can be constructed in a range of sizes in order to operate in all of its modes in water depths ranging between about 20 ft. to about 300 ft.

It is therefore, an object of the present invention to provide a mobile barge which has a lower hull and a vertical support member on which an upper hull is carried above the lower hull, and wherein a stabilizing hull is arranged for controlled movement between the upper and lower hulls through the operation of a control means in order to provide static stability for the barge while the lower hull is being lowered from a surface-floating mode into a bottom-resting mode and to provide for engagement with ice for failing ice features when the barge is in the bottom-resting mode.

Yet another object of the present invention is to provide a method of transporting a mobile barge to a drill site and to thereafter submerge a portion of the barge into bottom-resting contact with the sea floor while maintaining static stability for barge such that the barge is submerged while maintaining substantially a vertical attitude. This desirable object is attained by the use of the controlled movement stabilizing hull.

An additional object of the present invention is to provide a method of failing ice features by use of the intermediate stabilizing hull, as by exerting downward pressure on ice by moving the stabilizing hull downward onto the ice and by positioning the stabilizing hull adjacent the waterline to engage laterally moving ice to fail the ice in flexure.

These and other objects of the present invention will be understood from the drawings and detailed description.

DESCRIPTION OF THE PREFERRED EMBODIMENT

FIGS. 1–5 show the mobile barge 10 of the present invention in its three principal modes of operation. FIG.

Figure 2:
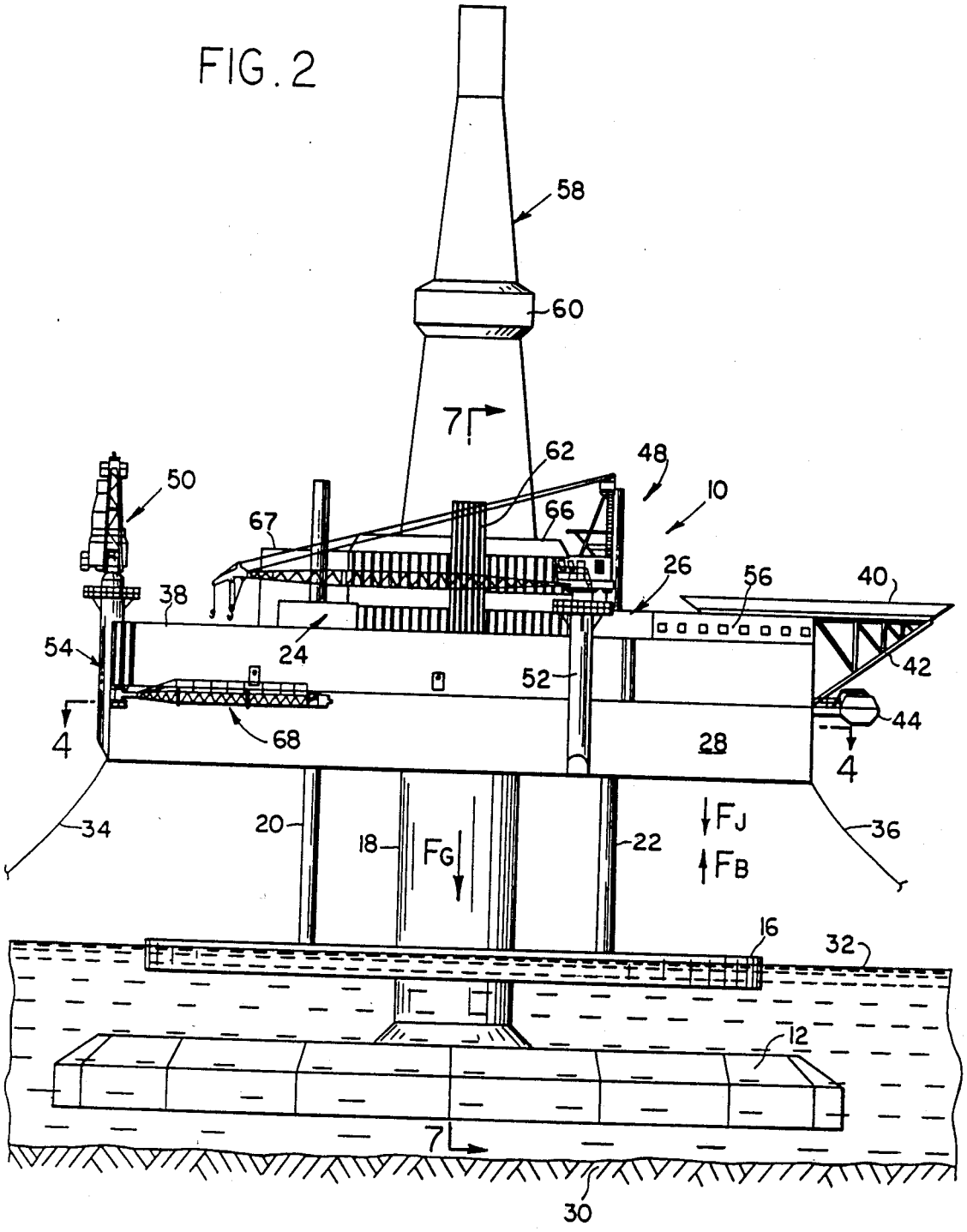
FIG. 2 illustrates a side elevational view of the barge with the stabilizing hull being raised relative to the upper hull to permit controlled descent of the lower hull.
Figure 3:
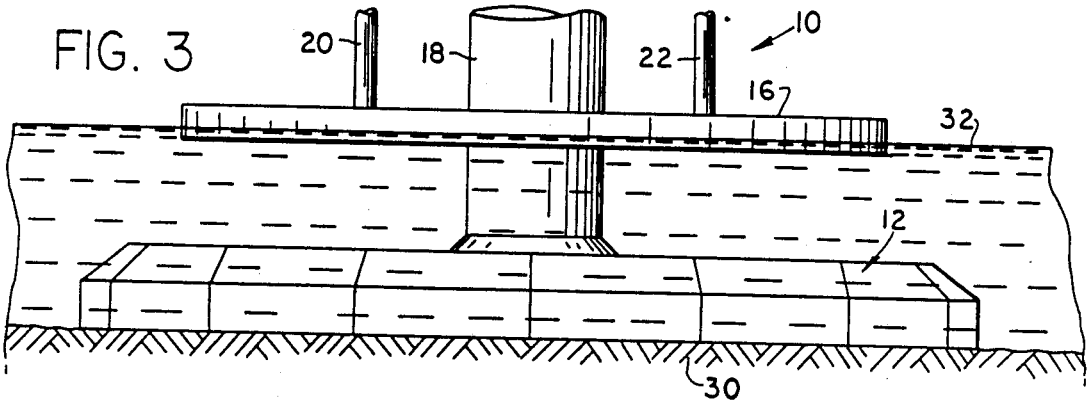
FIG. 3 is a fragmentary side elevational view showing the lower hull in fully-submerged, bottom-resting contact with the sea floor and the stabilizing hull in contact with the water.
Figure 8:
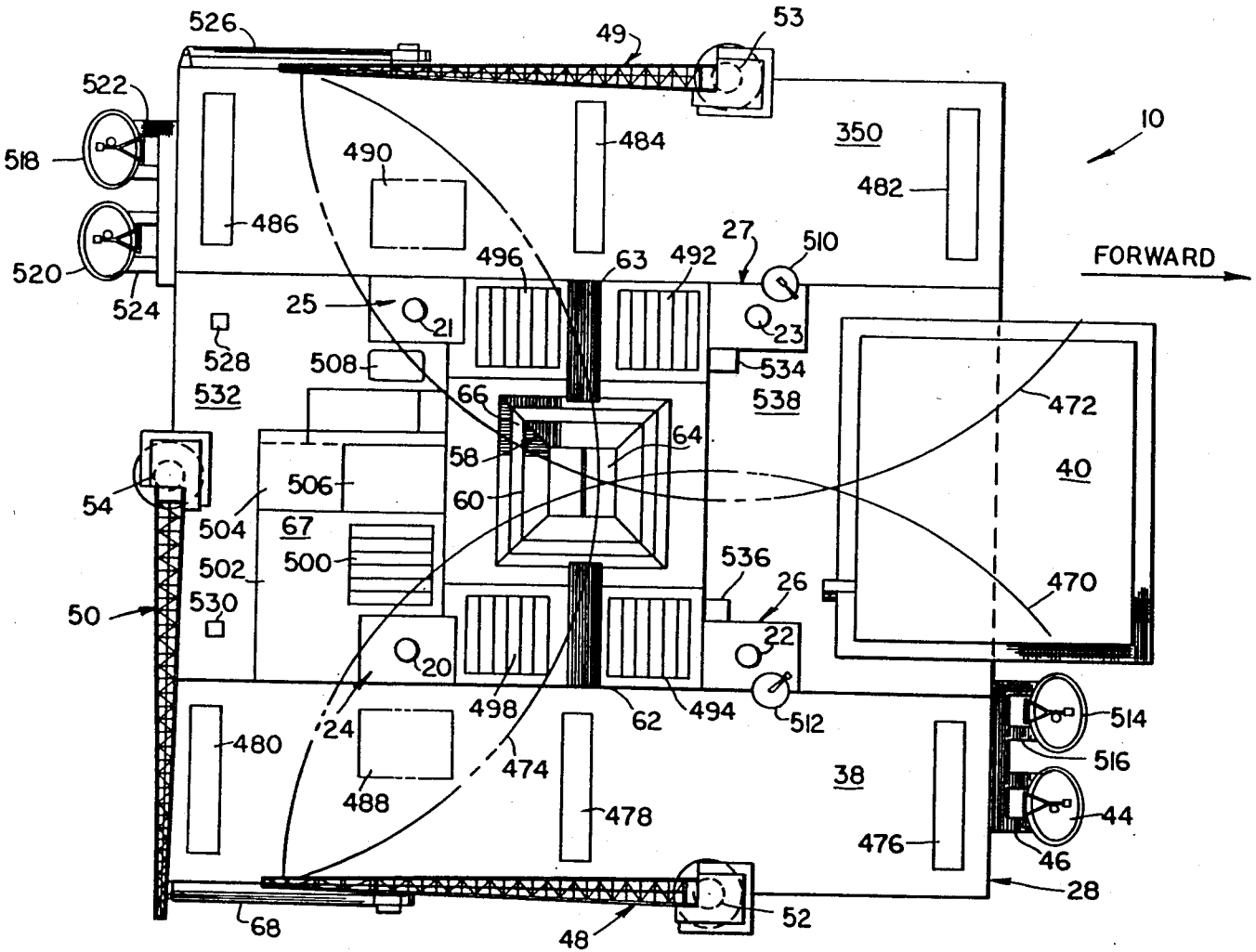
FIG. 8 is a plan view of the upper hull showing the external general arrangement of this hull.

1 shows the barge in the surface-floating mode of operation in which the buoyancy for the entire weight of the barge is provided by the displacement of the lower hull 12. The barge may be towed in this mode by a tug or work boat 14. FIG. 2 shows the mobile barge 10 in the submerging/emerging mode of operation used for bottom-founding or lift-off in which the static stability for the barge is provided by the moment of inertia of the waterplane area of the stabilizing hull 16 which is supported about the centrally-located support member 18 by starboard jacking legs 20 and 22 which have corresponding port jacking legs 21 and 23, as shown in FIG. 8. The jacking legs 20 and 22 are part of the control means 24 and 26 which are secured to the upper hull 28. Corresponding control means 25 and 27 are provided for the port side as shown in FIG. 8. FIG. 3 shows the lower hull 12 of barge 10 in bottom-resting contact with the sea floor 30. The stabilizing hull 16 shown in FIG. 3 is then lifted above the water surface 32, by force exerted from the jacking legs 20–23, into the raised position shown in FIG. 5. The entire weight of the barge is then supported on lower hull 12 through the single, centrally-disposed, support member 18 to provide a bottom-supported gravity structure within which safe drilling operations can be conducted without exposure to harsh environmental conditions such as prevail in the arctic and antarctic geographic areas. The preferred support member 18 is in the form of a cylindrical column.

The operation of the stabilizing hull 16 combined with the control means 24–27 permits the barge 10 to be bottom-founded to and lifted-off from its bottom-resting mode of operation for submergence or emergence of the lower hull in relatively short time periods. This feature then permits increased mobility of the barge 10 by permitting time-efficient and hence, economical moves between drilling sites. This feature combined with the towability illustrated in FIG. 1 wherein the barge has sufficient buoyancy provided by lower hull 12 to permit towing by a tug 14 provides a barge for offshore drilling in relatively shallow waters which has important operational advantages over more complicated bottom-founded rigs which require time-consuming submerging procedures for safe bottom contacting.

Figure 1:
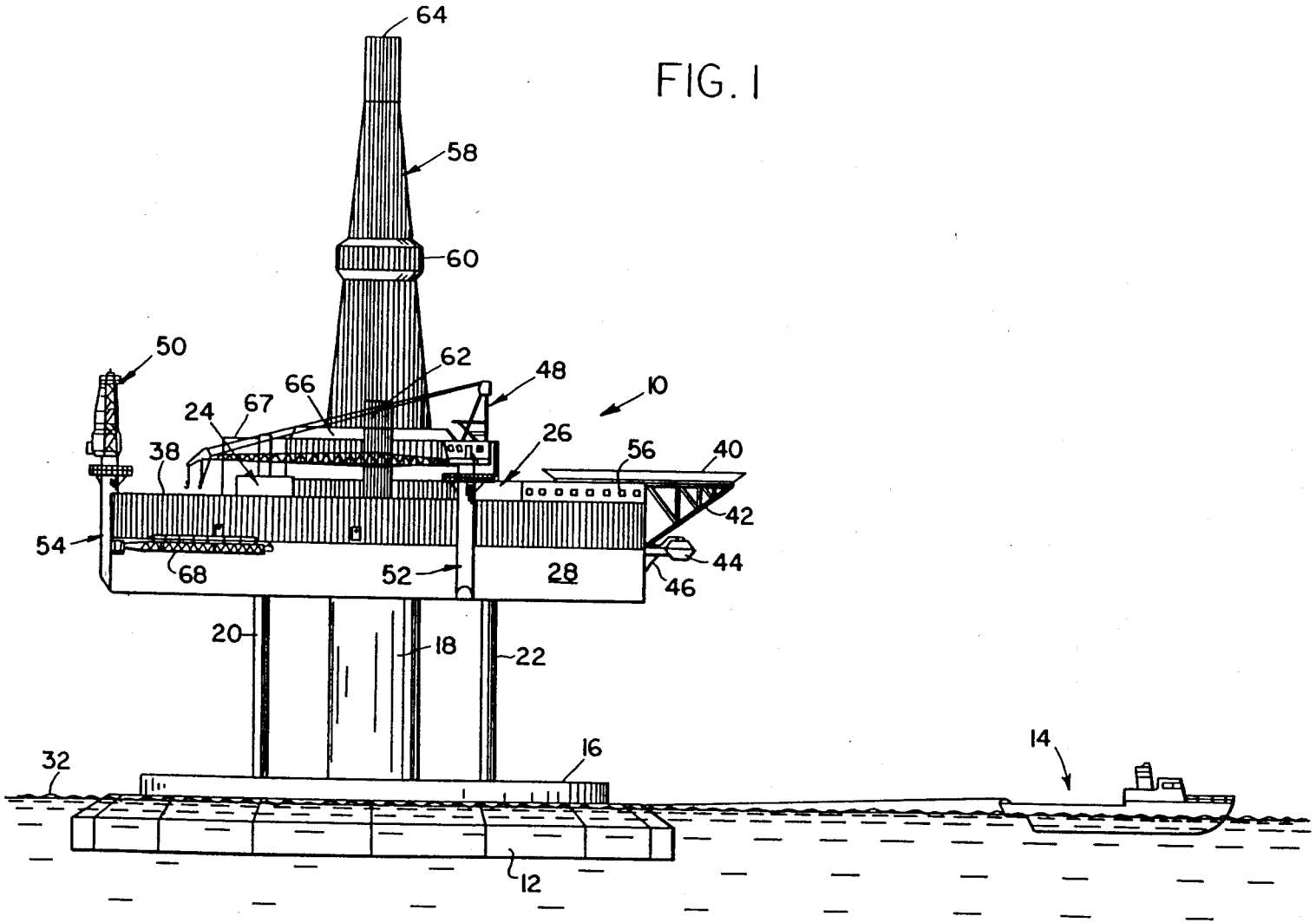
FIG. 1 is a side elevational view of the mobile barge in the surface-floating transmit mode.
Figure 4:
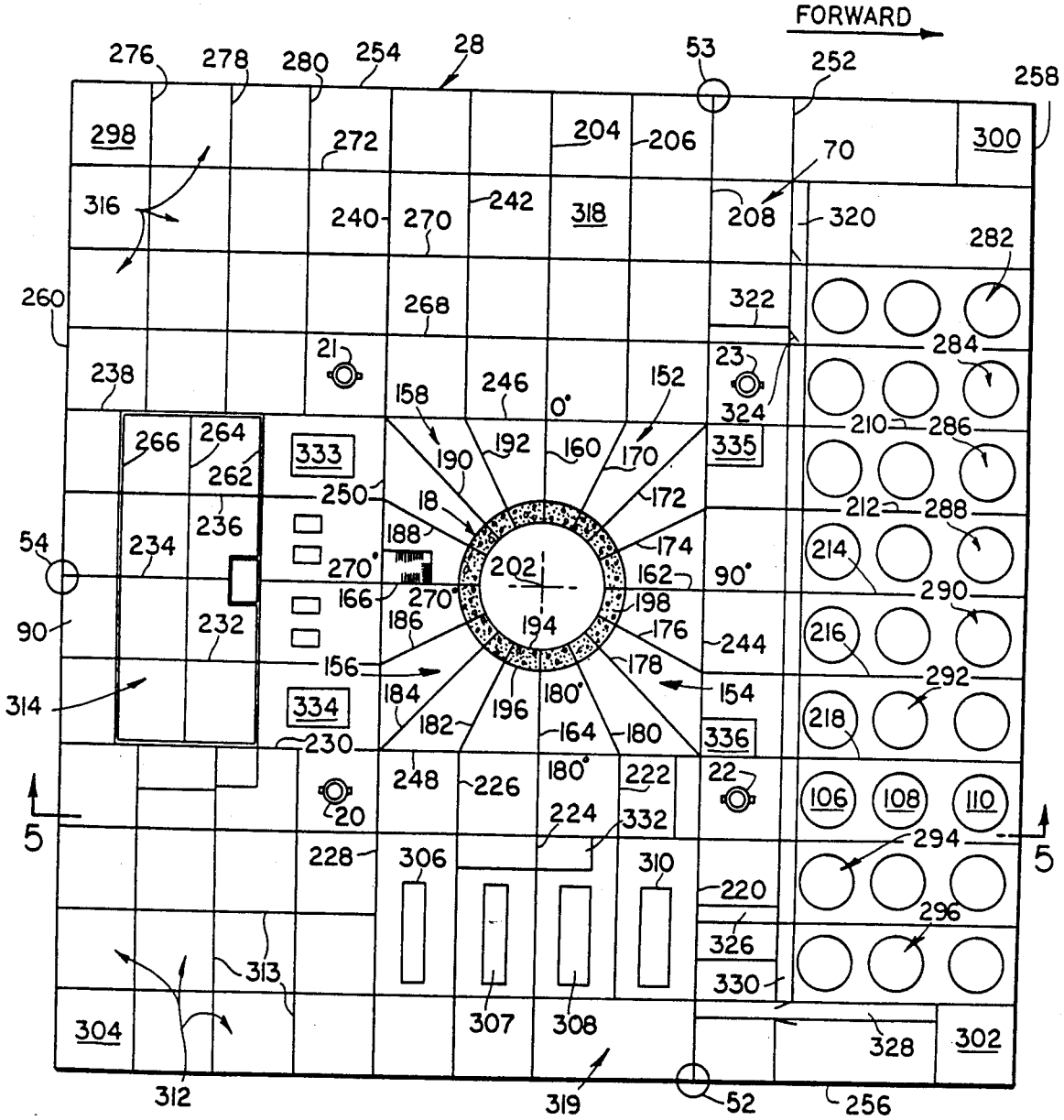
FIG. 4 is a schematic plan cut-away view of the working deck of the upper hull taken on line 4—4 of FIG. 2 showing the connection of the upper hull to the support column.
Figures 5, 6, 10:
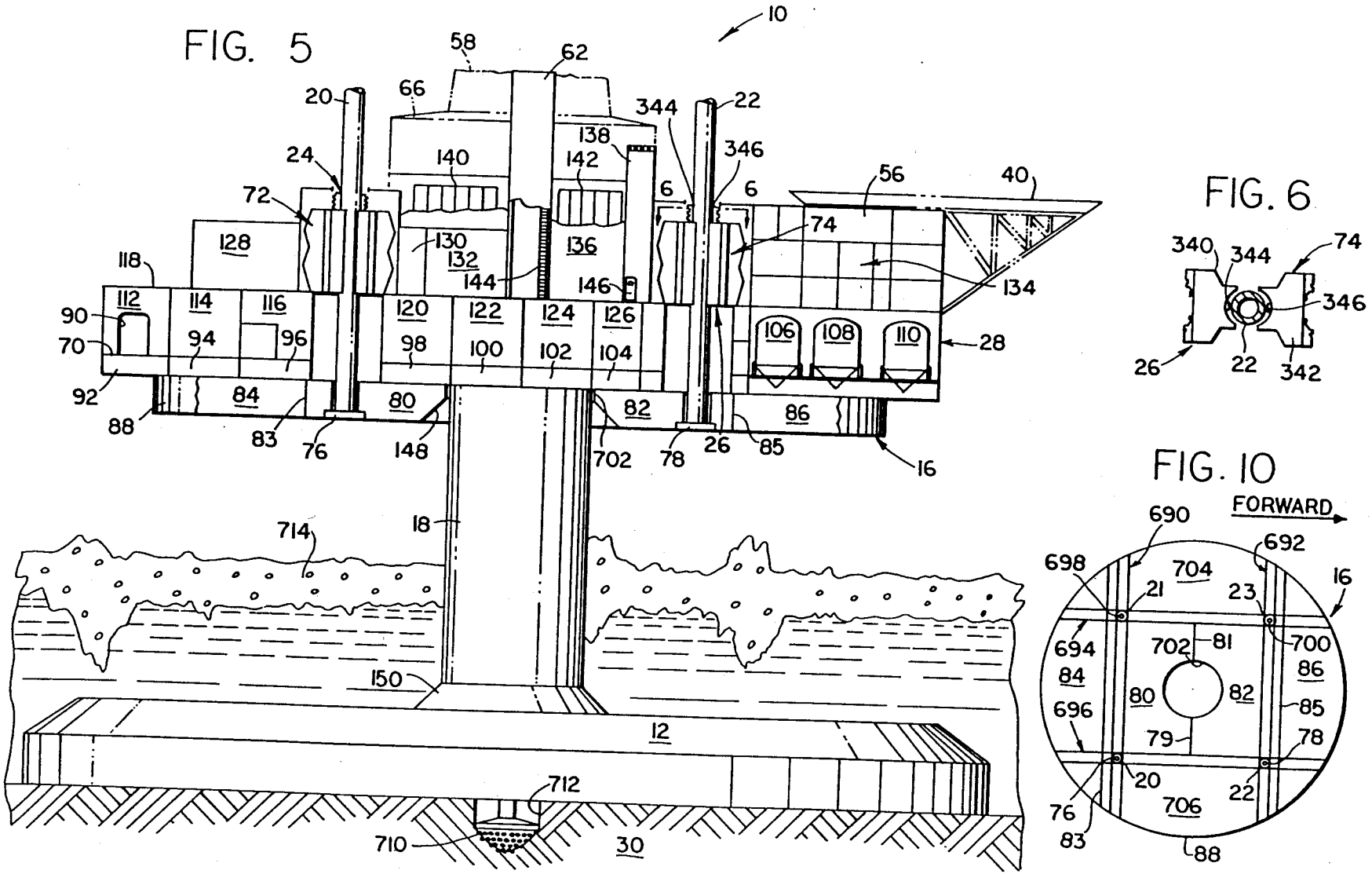
FIG. 5 is a fragmentary cut-away side elevational view of the upper hull showing a schematic cross-section of the upper hull and the stability hull in stored position immediately below the upper hull.
FIG. 6 is cross-sectional view of a jacking leg and jacking unit taken on line 6—6 of FIG. 5.
FIG. 10 is a schematic plan view of the framing and ballast tanks in the stabilizing hull.
Figures 7, 11:
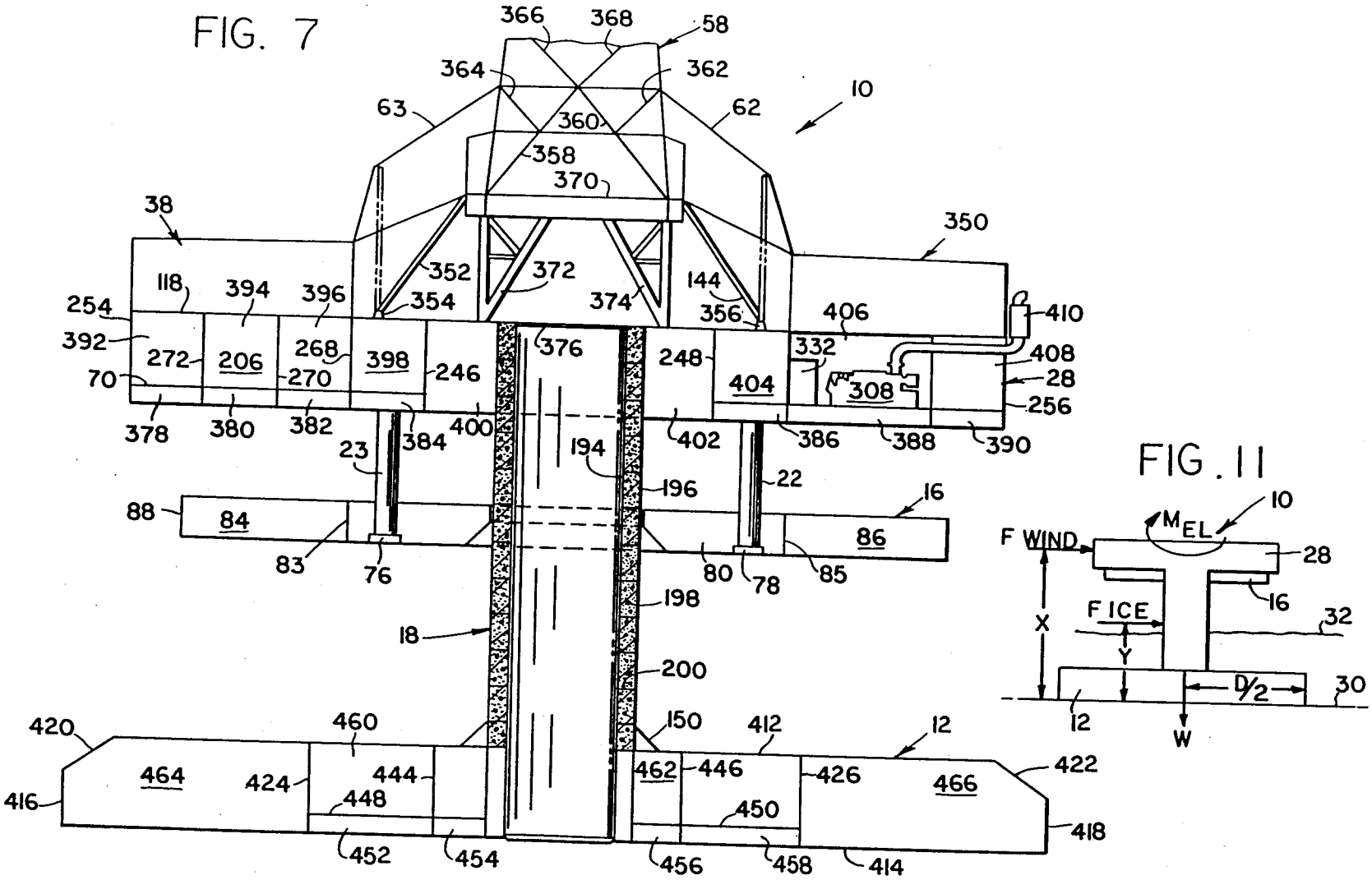
FIG. 7 is a partial cross-sectional view taken on line 7—7 of FIG. 2 showing the structure of the support column together with a schematic cross-section of the upper hull taken 90° from that of FIG. 5.
FIG. 11 is a schematic diagram of the barge illustrating the overturning moments acting thereon.

The preferred embodiment of barge 10 illustrated in FIGS. 1–10, is temporarily secured over a drilling site by mooring lines 34 and 36 shown in FIG. 2 which are secured to the sea floor by conventional anchor systems. A pipe deck enclosure 38 is mounted on the top side of upper hull 28 in order to provide an enclosed space for handling drilling tubulars. This enclosure is provided with pipe racks and an overhead gantry crane (not shown) for internal, protected handling of the drilling tubulars. A helideck 40 is cantilevered over the front or bow side by a truss work 42. Escape or survival capsules illustrated as capsule 44 are attached by brackets shown at 46 to upper hull 28 as shown. Rotating boom cranes 48, 49, and 50 are mounted on side posts 52, 53, and 54, respectively. These side posts are integrally affixed to the outer surfaces of the lower hull and the pipe deck enclosure 38 at the positions shown. The boom cranes 48, 49, and 50 are of conventional construction. Operational and crew quarters 56 are provided on the top deck as shown immediately under the helideck 40. A derrick enclosure 58 is provided in a central location on the top of the pipe deck enclosure level. This enclosure is formed with an enlarged racking platform enclosure 60 and has drilling tubular ramp roofs 62 and 63 connected between the pipe deck enclosure 38 and the derrick enclosure 58 to facilitate the movement of drilling tubulars or drill pipes between the two enclosed spaces. The derrick enclosure 58 is fitted with a crown plate 64 as best shown in FIG. 8. A drill floor cover roof 66 is connected between the base of the derrick enclosure 58 and the top of the pipe rack enclosure 38. The area below the drill floor cover roof 66 is sufficient to accommodate equipment spaces for the blow out preventer (BOP) and the BOP guide base which are installed on the wellhead upon completion of drilling operations. The drill floor is mounted above the main deck under the roof cover 66 and is centered with respect to the support column 18 as best shown in FIG. 7. The outside surface of the pipe deck enclosure 38 and the derrick enclosure 58 preferably can be of light metal plating having widely spaced reinforcement ridges therein as illustrated in FIG. 1. A rotatable burner boom 68 is also provided for flaring gas away from the machinery deck 70 which is enclosed by the upper hull 28 as shown in FIG. 5.

Also shown in FIG. 5 are the jacking units 72 and 74 which grip the jacking legs 20 and 22 for raising and lowering of the stabilizing hull 16 relative to the upper hull. The jacking legs are secured to the stabilizing hull 16 by moment connection members 76 and 78. Connections of the jacking legs to the stabilizing hull which transmit forces and moments are preferred to pin connections which do not transmit moments. For either type of connection the inner dimension of the stabilizing hull can be fitted closely enough to a straight-sided central support member 18 so that the horizontal forces acting on the stabilizing hull are taken out by reaction against the support member. The moment connections do, however, offer the additional design freedom of not requiring contact with the support member. When contact between the stabilizing hull 16 and the central support member 18 is not required, the central support member can be nonstraight-sided for a portion or all of its height. The horizontal forces acting on the stabilizing hull can then be transmitted through the jacking legs to the upper hull.

The stabilizing hull 16 is divided into ballast tanks 80 and 82, which are located in the central positions of the stabilizing hull, and additional ballast tanks 84 and 86, which are formed in the peripheral positions of the stabilizing hull. The stabilizing hull 16 is shown as having a circular formed periphery 88 but a polygon shaped periphery can also be employed. Ballast pump means (not shown) are provided in both the stabilizing hull 16 and in the upper hull 28 for ballasting and deballasting tanks 80–86. The tanks 80–86 are arranged circumferentially around the support column 18. The tanks 80 and 82 are radially positioned inward from the peripheral, circumferentially distributed tanks 84 and 86.

FIGS. 4 and 5 also show a fork lift passageway 90 which is positioned on machinery deck 70 for the moving of barge stores. Void spaces 92–104 are provided immediately below the machinery deck 70 to provide for insulation against arctic temperature. Bulk cement tanks 106–110 are also provided on the machinery deck as shown. Storage rooms 112–116 are provided in the radially spaced location opposite the bulk cement tanks. The more centrally located spaces between the machinery deck 70 and the main deck 118 are used for shop and equipment rooms 120–126. A well testing equipment laboratory 128 is mounted on main deck 118 adjacent to jacking unit 72. Additional service shops 130 and 132 are also provided on the main deck. Additional equipment and crew space is provided on the main deck 118 as shown by room 134. Space 136 is employed for storage of the BOP guide base. A stairway column 138 provides access to the drill floor and the derrick tower. Folding hatch areas 140 and 142 are provided for opening in favorable weather. The drilling tubular ramp roof 62 also houses a "V" ramp 144, which is motor driven in order to provide lifting of drilling tubular stock from the pipe deck upwardly into the derrick enclosure 58. The stairwell casing 138 is provided with an access door 146 which opens off of the main deck 118. FIG. 5 also shows the beveled flange formed in the lower portion of the inner radius 148 of stabilizing hull 6 which is designed to mate with the sloped base flange 150 of the support column 18 which is designed to permit the stability hull 16 to rest directly upon lower hull 12.

FIG. 4 shows the connection of upper hull 28 to the support member or column 18 through a series of sixteen radially positioned frame members grouped in the four quadrants 152, 154, 156, and 158. These members cannot be seen in above-described FIG. 5. Each quadrant is defined by a framing member positioned at the quadrant angles of 0°, 90°, 180°, and 270°, shown as members 160, 162, 164, and 166. Within each quadrant three intermediate framing panels are approximately equally radially spaced as shown in quadrant 152 as members 170, 172, and 174. The second quadrant 154 intermediate frame members 176, 178, and 180 correspond in position. The remaining two quadrants have intermediate members 182–192, respectively. The sixteen radially positioned framing members are integrally interconnected through the wall of member or column 18 which is shown constructed of an inner shell 194 and an outer shell 196. The space between the shells is filled with concrete 198 and the shells are interconnected by the radial frame members as well as other reinforcing members 200 shown in FIG. 7.

FIG. 4 also shows a top plan view of the machinery deck 70 with the frame members 160–192 positioned radially with respect to the central axis 202 of column 18 to provide a high-strength structural connection of the upper hull 28 to the support column 18 and to provide adequate foundation for the main deck 118 and the pipe rack enclosures 38 and 350, and the derrick enclosure 58. The vertical height of the framing members 160–192 illustrated in FIG. 4 can be seen in FIG. 7 as extending from the bottom surface of the upper hull 28 to the main deck 118. These frame members are integrally connected to the upper hull structural panels 204 through 242, numbered clockwise from 0°, which form extensions of the radial positioned members and are arranged in longitudinal and transverse directions as shown. Upper hull framing panels 208 and 210 are extensions from the single radially positioned frame member 172 as shown. In addition these two framing panels are also extensions of the central box frame members 244 and 246, respectively. The central box frame is completed by frame members 248 and 250. Additional reinforcement framing panel 252 is arranged to the foreside of the support column 18 in a transverse direction and is integrally interconnected to the outer panel frame 254 on the port side and framing panels 210–218 on the foreside of box frame member 244 as well as to the starboard outer panel 256. The foreside outer panel 258 and the aft outer panel 260 complete the outer shell of the upper hull 28 and are connected at the corners to outer side panels 254 and 256.

An offset group of three transverse frame panels 262, 264, and 266 are arranged in the area to the immediate aft direction of the central box frame member 250 and are interconnected to frame panels 230, 232, 234, 236, and 238. On the port side of the machinery deck 70 three longitudinally aligned framing panels 268, 270, and 272 are spaced between box frame panel 246 and the outer side panel 254. A series of transverse connecting framing panels 276, 278, and 280 are connected to panels 268–272. The above-described type of framing is then completed throughout the volume occupied by the upper hull 28. Within the enclosed spaces formed by the framing panels within upper hull 28 are the bulk cement storage tanks 106, 108, and 110 as illustrated in FIG. 5 and additional series of such bulk cement tanks illustrated generally as 282 through 296. The four cornermost spaces 298, 300, 302, and 304 are used for anchor windlass-chain locker compartments. The diesel engine generator 308 shown in FIG. 7 is seen in this machinery deck plan view along with three additional diesel generators 306, 307, and 310. The spaces designated generally as 312 formed by the lattice of frame panels 313 are employed for the storage of crated mud sacks. The eight areas designated generally as 314 formed by frame panels 230–238 and 262–266 are employed for a series of four 1,000 barrel mud pits. The fork lift passageway 90 is provided for transport of the mud sacks to the mud pit area. Additional mud sack storage is provided in the areas generally designated as 316. The general ship stores area is designated as 318. The remaining spaces formed by the framing panels such as designated at 319 are utilized for a variety of equipment and servicing rooms. Doorways and corridors 320–330 are provided where necessary. An engine control room 332 is also provided. The mud pumps 333 and 334 are shown diagrammatically in the aft section and stair wells 335 and 336 are in the foresection. The crane pedestals 52, 53, and 54 are also shown in FIG. 4.

FIG. 6 shows a view of the control means 26 taken on line 6—6 of FIG. 5 shows a four-pinion tubular-leg hydraulic jacking unit 74 in which the mating supports 340 and 342 contain hydraulic pump units. The jacking unit 74 contains gripper elements 344 and 346 (best viewed in FIG. 5) which are cog toothed at their outside surfaces as shown for the application of motive power thereto for moving the jacking leg 22 relative to the supports 340 and 342. Suitable jacking units 72 and 74 can be obtained from the Baker Co. which have 2400 short tons elevating capacity and 4800 short tons holding capacity. The hydraulic pump units are maximum rated at 3000 psi. The four jacking units employed on barge 10 thus produce a total of 9600 short tons submerging or elevating capacity.

FIG. 7 shows a schematic cross-sectional diagram of barge 10 taken on line 7—7 of FIG. 2 and is thus shown at 90° from the FIG. 5 view. Stabilizing hull 16 is shown connected to upper hull 28 by jacking legs 22 and 23 about column 18. The pipe ramp roof 62 and the corresponding roof 63 are shown joined to the base portion of derrick enclosure 58. The lower edges of these ramp roofs are connected to the top surfaces of the pipe rack enclosures 38 and 350. The two "V" ramps 144 and 352 are shown as pivoted into the solid line operative positions shown for lifting drilling tubular stock from the pipe rack enclosures into the derrick enclosure 58. The derrick superstructure consists of support members 358–368 of conventional construction. The drill floor 370 is shown centrally mounted under the derrick enclosure 58 by support frames 372 and 374. The drilling floor is spaced from and centered over moon pool 376 which is centered within the inner shell 194 of support column 18. This column consists also of an outer shell 196 and a series of internal reinforcement members 200 as described above. The annular space between the inner and outer hulls is filled with concrete 198 to provide vertical compressive strength for the central support column 18. Stability hull 16 is shown as supported by the representative jacking legs 22 and 23. A series of void spaces 378–390 are provided below machinery deck 70 at the same elevation as void spaces 92–104 in FIG. 5 and are to provide the same insulation function. The divided tanks or rooms 392–408 which are formed by the framing panels are situated over the machinery deck 70 and are used for storage of various process materials, equipment, including spud-in equipment, and ship stores. .Tanks 400 and 402 are used for drill water and potable water, respectively. Engine room 406 contains one of the barge engines 308 which is controlled from room 332. Compressors can advantageously be located in room 408 which has the engine muffler and exhaust 410 located thereabove. The pipe rack enclosures 38 and 350 are mounted above main deck 118 and provide for the positioning of pipe racks and pipe handling machinery (not shown). The pipes or drill tubulars can be onloaded by rotating cranes 48, 49, and 50 and stored in the pipe handling enclosures 38 and 350. The pipes or tubes are then moved onto position by pipe handling machinery and then onto the "V" ramps 144 and 352 for handling into the derrick enclosure 58.

Lower hull 12 is shown affixed to the lower end portion of support column 18 and has an upper roof plate 412 and a base plate 414 which are spaced from one another to create internal tank compartments. Peripheral panels 416 and 418 have hipped portions 420 and 422, respectively, which are representative of the other peripheral panels of the lower hull. The internal tanks are formed, in part, by the vertically disposed watertight bulkheads 424 and 426. Swash bulkheads 444 and 446 are employed to increase the structural integrity near the support column 18. Tank floors 448 and 450 are spaced from the bottom panel 414 in order to create a series of void spaces 452–458 which serve to provide damage protection for the fluid stored in the tanks 460 and 462. These tanks, which are spaced radially close to support column 18, are utilized for the storage of fuel oil. The outer circumferential tanks 464 and 466 are utilized for ballast sea water and are employed during the bottom founding operation described below. The lower hull internal framing and fuel tank and ballast tank arrangement will be described further in reference to FIG. 9 below. FIG. 8 shows details of the roof and hatch areas of the upper hull 28. The crown plate 64 of the derrick enclosure 58 can be seen in the central location as well as other portions of the drill enclosure structure. The "V" ramp enclosure roofs 62 and 63 are seen connecting the derrick enclosure 58 with the pipe rack enclosures 38 and 350. The on-loading of pipe is handled by rotating cranes 48, 49, and 50 which have boom outer curvatures denoted by phantom lines 470, 472, and 474, respectively. The control means 24, 25, 26, and 27 can also be seen in this top view with the jacking legs 20, 21, 22, and 23 mounted therein.

Drilling tubular access hatches 476, 478, and 480 are provided for pipe rack enclosure 38 and access hatches 482, 484, and 486 are provided for pipe rack enclosure 350. Crane transfer areas 488 and 490 are provided on top surfaces of the roof of enclosures 38 and 350, respectively. Special reinforcement is used in the roofing structure for this purpose. Drilling tubulars are loaded onto barge 10 by the rotating cranes 48, 49, and 50 through the access hatches 476–486 wherein they are further handled by pipe handling equipment (not shown). Folding access hatches 492, 494, 496, 498, and 500 are also provided in the upper surface of the roof structure 67. These hatches can be opened in fair weather. Well testing equipment is stored in enclosure 502 below aft roof 67 as are the mud process equipment and the Schlumberger unit in enclosures 504 and 506, respectively. The mud pump hatch 508 is shown adjacent to jacking unit 25. Foam monitors 510 and 512 are provided as fire prevention equipment. Helideck 40 and escape capsule 44 are seen on either side of escape capsule 514 which is mounted on brackets 516. Aft escape capsules 518 and 520 are mounted on support brackets 522 and 524, respectively. A port burner boom 526 is also provided in the same position as boom 68 on the starboard side. Mud sack access hatches 528 and 530 are also seen in the aft roof 532. Stair enclosures 534 and 536 protrude above the fore roof 538.

DETAILED CONSTRUCTION OF LOWER HULL

Figure 9:
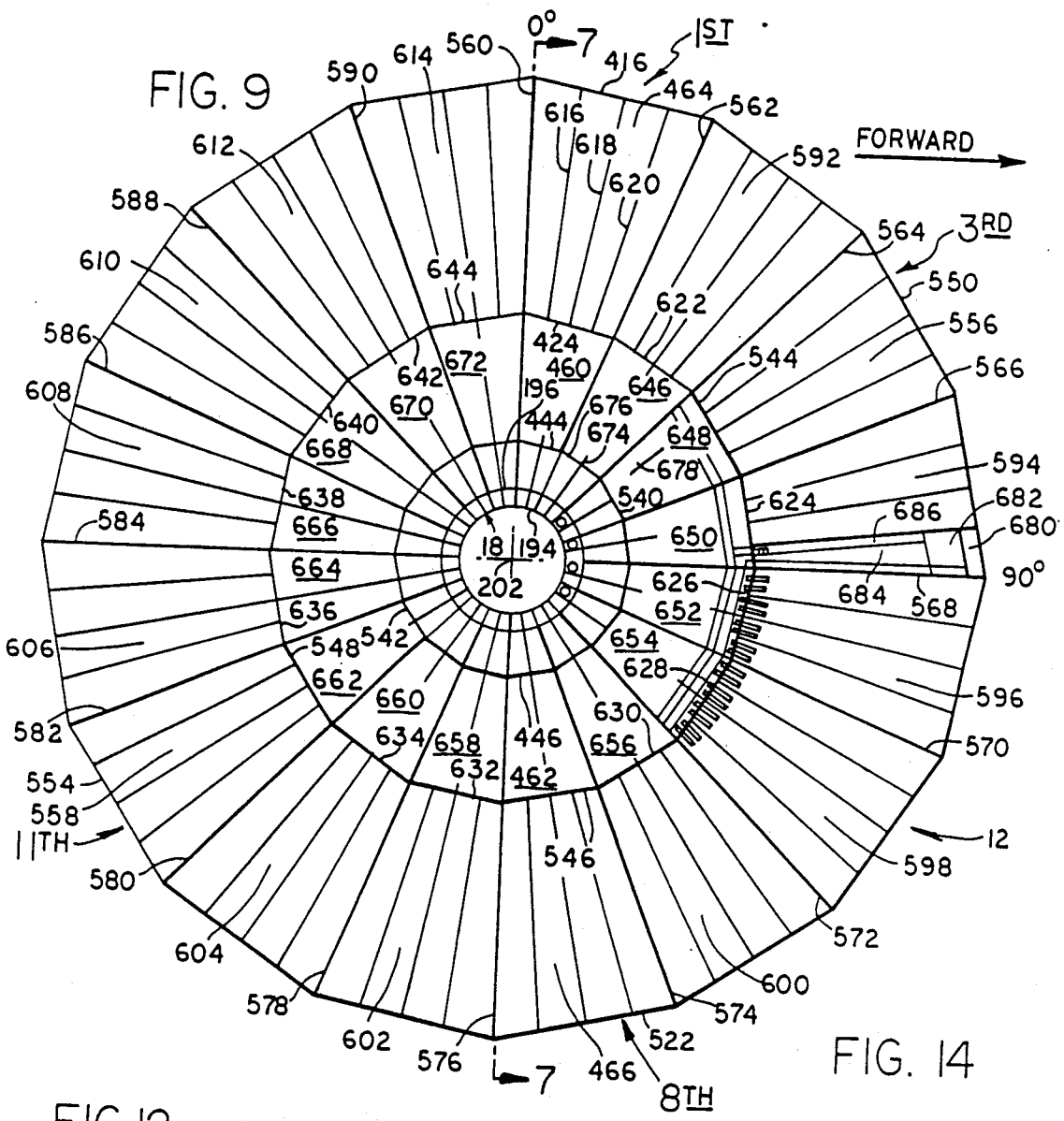
FIG. 9 is a schematic plan cut-away view of the lower hull showing the ballast compartments and the bottom portion of the drilling shaft.

FIG. 9 shows the internal arrangement of watertight and swash bulkheads in the lower hull 12 in plan view. The orientation of the view shown as FIG. 7 has been shown along line 7—7 for convenience. The lower hull is composed primarily of four concentric volumes. The innermost part is the support column 18 which is centered about the axis 202. The next concentric volume is formed by a series of sixteen swash bulkheads exemplified by bulkheads 444, 540, 446, and 542, which have been selected at spaced intervals and are numbered clockwise from 0°. This series of swash bulkheads is spaced from the support column 18 and provides structural stability for the lower hull at a position near to the center where large bending moments will be concentrated in barge 10.

The next concentric volume is defined between the abovedescribed sixteen swash bulkheads and a spaced series of sixteen watertight bulkheads exemplified in bold lines as bulkheads 424, 544, 546, and 548 which have been shown for the same wedge-shaped areas as are associated withthe above-numbered swash bulkheads. A detailed description of the selected and identified first, third, eighth and eleventh wedge-shaped volumes is set out as exemplary of all of the volumes. The next outward concentric volume is defined by the outer or peripheral shell walls 416, 550, 552, and 554 which have been identified at the outer positions for each of the illustrative wedge-shaped areas and which form the outer walls for ballast tanks 464, 556, 466, and 558, respectively. The wedge-shaped areas are formed by radially arranged watertight bulkheads 560–590 which form the series of sixteen watertight ballast tanks of which tanks 464, 556, 466, and 558 are members. The other ballast tanks in this series in the outer circumferential position are identified as 592–614 numbered clockwise from 22.5°. Each of these ballast tanks is formed by the spaced watertight bulkheads shown in bold lines and the outer panel associated with the wedge-shaped volume formed by two adjacent radial watertight bulkheads. Tank 464 is formed by radial bulkheads 560 and 562, the interior vertical bulkhead 424 and outer panel 416; and is further subdivided by three radially spaced swash bulkheads 616, 618, and 620. Each of the circumferentially positioned sixteen ballast tanks are arranged in a similar fashion and interior vertical watertight bulkheads 622–644 are provided together with previously described bulkheads 544, 546, and 548 for that purpose.

The next innermost concentrically spaced tanks are formed between the vertical bulkheads positioned at the intermediate hull position, the radially positioned bulkheads and the outer shell 196 of column 18. The first of these tanks used for fuel storage and equipment spaces clockwise from 0° is 460, followed by 646–656, 462, and 658–672. Each of these tanks or spaces except 648, 650, 652, and 654 are further subdivided by a radially positioned swash bulkhead 674 and a chordal swash bulkhead 676 as illustrated for the exemplary tank 646. The four spaces not subdivided radially are used as equipment rooms. Room 648 is employed to store an air masker system 678 and associated equipment referred to in greater detail of use below. Rooms 650, 652, and 654 are utilized for various ballast control equipment and pumps. A sea chest 680 is provided in a walled-off portion of ballast tank 594 and is provided with a valve compartment chamber 682 for controlling entry of sea water through a flooded pipeway 684. Watertight passageway 686 is provided for access to the valve compartment 682.

Each of the tanks is thus additionally reinforced by internal vertically-arranged swash bulkheads.

FIG. 10 illustrates the internal framing for the stabilizing hull 16. The jacking columns or legs 20–23 are shown secure in boxes formed by the double frame construction of transverse frame panel pairs 690 and 692 and longitudinal frame panel pairs 694 and 696. The legs are retained in the stabilizing hull by moment connections 76, 78, 698, and 700. The circular outer skirt panel 88 forms the perimeter. The interior watertight bulkheads 79, 81, 83, and 85 are seen in top plan view. Center neck 702 permits passage along the outside of column 18 of the barge 10. This neck and the longitudinal and transverse frame panel pairs form the ballast tanks 80 and 82. The frame panels also form the peripherally spaced ballast tanks 84, 86, 704, and 706.

The materials of construction of barge 10 are generally of three types. The inner and outer shells 194 and 196 of the support column 18 are preferably constructed of a high strength steel with improved notched toughness at low temperatures. This same high strength steel is employed for the connecting members which pass through and are supported by the central support column 18. The internal framing panels and the operating deck flooring are constructed of the same high strength steel. The external panels for both the upper and lower hulls which are exposed to the arctic environment are constructed of low temperature steel.

MODES OF OPERATION

Having thus described the objectives, concepts, construction, and general operations of barge 10 the detailed operations will now be described. Barge 10 can be towed from its construction site at a shipyard to a first drilling location as illustrated in FIG. 1. An alternate transit method is to float the barge onto a ship which is construcuted with a submersible main deck. Such ships have elevated bow and stern portions. This achieves the additional advantage of lower resistance transit.

When positioned at a drilling site by mooring lines 34 and 36 as shown in FIG. 2, the lower hull 12 is jacked down by control means 24, 25, 26, and 27 through force exerted through the jacking legs 20, 21, 22, and 23. Stabilizing hull 16 establishes a waterplane area which is sufficiently large so that the inertia of this waterplane area gives the overall barge 10 adequate stability to permit a controlled descent of the lower hull 12. Since the lower hull is below the surface of the water, it does not contribute to the moment of inertia of the waterplane area, but it does have an effect on the dynamic response of the barge to wave conditions. This dynamic response is usually expressed in terms of the response amplitude operator curves for various barge motions such as heave, pitch, and roll. The shapes, position, and relative scale values of these curves depend upon various technical considerations including the shape of the lower hull 12 and the area and the moment of inertia of the waterplane area of the stabilizing hull 6. The displacement mass of the lower hull and the added mass due to lower hull shape are both important determinants of the scale position of the curve. The large horizontal area of lower hull 12 will effectively shift the natural period portion of the response curve to be above the anticipated wave spectrum for most sea states, and will provide a response period above the periods of maximum energy of wave spectra encountered in the arctic seas in which the preferred vessel is to be used.

In order to submerge the lower hull by use of the control means, five or six of the ballast tanks shown in FIG. 9 are first filled with sea water in order to control the jacking force required and to lower the barge center of gravity. The partial ballasting of the lower hull 12 enables it to be slightly submerged so that the water line contacts the overlying stabilizing hull 16. However, it is not possible to fill the five or six tanks simultaneously since to do so would quickly create a net gravitational weight minus the buoyancy force exerted by the lower hull which would result in an undesirably rapid descent for the barge. A limited number of ballast tanks are filled in a diametrically opposed sequential fashion. To illustrate this procedure, reference is made to FIG. 9. A typical sequence is that ballast tank 464 is first initiated in the flooding sequence. Next the diametrically opposed ballast tank 602 is started with sea water ballasting prior to completion of ballasting of tank 464. Next a ballast tank at 90° removed from 464 such as tank 596 is initiated with ballasting and thereafter opposed tank 608. The next tank sequence is started with intermediate positioned tank 600 and then the diametrically opposed tank 612. The direction of the ballast sequencing is deliberately reversed in this filling sequence to prevent spiral submergence of lower hull 12 and enables a non-rotational and non-spiralling controlled descent for lower hull 12. This method of lower hull ballasting creates a net gravitation force for the lower hull which permits submergence in a controlled manner.

As can be seen from FIG. 1, the submergence of lower hull 12 brings the stabilizing hull 16 into contact with the water surface. The moment of inertia of the stabilizing hull is determined by the area of the water plane intersected by the hull and the position of this area. The preferred embodiment stabilizing hull 16 has a moment of inertia of about 100 million $ft^4$. This large moment of inertia then provides static stability for the barge 10 during bottom founding.

When the jacking down process is initiated the stabilizing hull 16 has a net buoyancy force, $F_B$, exerted in an upward direction as shown in FIG. 2. The remainder of barge 10, i.e. the lower hull support column and upper hull, exerts a net gravitational force, $F_G$, in a downward direction. The effect of these two forces then is that the control means 24, 25, 26, and 27 also exert a downward force, $F_J$, on jacking legs 20, 21, 22, and 23. These forces acting between the stabilizing hull and the remainder of the barge then place the jacking legs in compression. The buoyancy force, $F_B$, is thus operationally used to counteract the gravitational force, $F_G$, and is counteracted by the jacking force, $F_J$. If high waves are encountered during the bottom founding process this compressive force may be intermittent with tension forces occurring in one or more of the jacking legs.

The stabilizing hull 16 and the control means thus provides for both the transmission of net upward buoyancy force, $F_B$, and the static stability for the barge 10 during bottom founding. The control means then permit the lower hull to be jacked down in a controlled fashion so that the lower hull 12 impacts the sea floor in a nearly horizontal plane. This eliminates high loadings on any of the perimeter of the lower hull which could cause panel damage. This is an important operational advantage over bottomresting rigs which are dropped into sudden uncontrolled contact with the sea floor under the theory that such contact will provide the required vessel stability, even if suddenly.

As the lower hull 12 descends into contact with the sea floor 30 additional buoyancy is obtained from the water displaced by the increasing length of the center column. At a 66 feet depth this is equivalent to about 600 short tons of water for the preferred embodiment. The lower hull displacement is 43,000 short tons displacement. The 600 tons is thus just more than 1% of the total buoyancy. This will cause the water level to decrease about ½ foot relative to the sidewall of the stability hull 16. This rise in the relative water level position with respect to the overall buoyancy of barge 10 is a result of the stabilizing hull having a displacement of about 1,000 tons per foot (TPF) of vertical height. Due to this relative buoyancy movement, as the lower hull 12 is descending into bottom resting contact with sea floor 30, the impact is even under greater control than if the barge were held at the same relative buoyancy position.

During the time that the bottom-founding process illustrated in FIG. 2 is being carried out attention should be given to the current, wind, and wave forces which are acting on this large barge 10. The stabilizing hull 16 is displacing a large waterplane area in order to provide a large enough moment of inertia to provide vessel stability against these forces. The diameter of the stabilizing hull as well as the depth of the hull must be sufficient to allow the bottom founding to occur while having no greater than 4° out of trim. The maximum environmental operating envelope established for the preferred embodiment with respect to these forces is specified as a wind of 20 knots, a current of 1.5 knots, and waves of 5 feet significant height.

Controlled bottom founding means the raising of the stabilizing hull relative to the upper hull 28 with the provision of upwardly-directed buoyancy force from the stabilizing hull, $F_B$, which does not exceed the capacity of the jacking units of the control means, and presence of a substantial moment of inertia of the water plane area developed by the stabilizing hull.

After the sea bottom 30 has been contacted by the lower hull 12 as shown in FIG. 3 the bottom-resting gravity weight of the barge can be adjusted to achieve sufficient friction with respect to the sea floor soil to prevent sliding from wind and ice floes. In order to resist sliding of the preferred embodiment of barge 10 in most of the soil conditions in the Beaufort Sea, it is necessary for the 270 feet diameter lower hull to have about 25,000 tons resting on the sea floor. This necessary weight is achieved by adding ballast to the remaining unfilled ballast tanks in lower hull 12. Also, in order to help achieve this weight the stabilizing hull is drawn up to a resting position immediately below the upper deck 28 by use of the control means 24, 25, 26, and 27 and thereafter the ballast tanks in the stabilizing hull are filled with additional sea water to increase the bottom-resting weight. It is necessary to add the ballast water above the mean water line to increase the gravity weight of the vessel in a substantial fashion since the available ballast tanks in the lower hull have already been utilized.

The ice floes which occur in the Beaufort Sea can exert approximately 2 billion foot lbs. of overturning moment in 70 ft. water depth for the preferred configuration. This overturning moment must be reacted by the area of the bottom surface of the lower hull 12 while not imposing too great a soil bearing pressure on the sea floor.

The support column 18 has an outside diameter of 40 feet and an inside diameter of 30 feet; thus, the column walls are 5 feet in thickness. The support column 18 is designed to resist the force exerted by approximately a 15 feet thick ice floe. The small outer diameter of the support column compared to the diameter of the lower hull and upper hull dimensions presents only a small ice contacting area.

BARGE BREAKOUT

Barge removal occurs in the reverse order to the bottom-founding operation. First the stabilizing hull is deballasted. Then the lower hull is deballasted in a sequential fashion in order to achieve a negative buoyancy of about 500 tons. This means that 500 tons of additional displacement would still be necessary in order to float the submerged weight free from the bottom if there were no adhesion forces being exerted by the sea floor soil. The third step is to jack down the stabilizing hull 16 until it is nearly completely submerged in order to get a positive buoyancy of about 11,000 short tons; or until the barge breaks free from the sea floor. The diameter and height of the stabilizing hull 16 thus determine the displacement which determines this buoyancy force.

As the bottom surface of the stabilizing hull is jacked below the water surface an uplift force is applied to the upper hull, water will begin to seep between the barge bottom and the sea floor, and the adhesion forces will decrease to the point where they are less than the net uplift force. At this point, the barge will break loose and the unit will ascend 10 feet or less, coming to rest in a floating position at the lower portion of the stabilizing hull 16. The jacking legs will be in compression during the third step of the lift off process unless heavy wave action causes large barge motion in which the compression is relieved and tension created.

The above-described breakout process can be shortened in time by employing an air masker system such as shown in FIG. 9 by block 678 in compartment 648. This system delivers compressed air through pipes (not shown) to a multiplicity of locations on the undersurface of the lower hull 12 in order to loosen the adhesion forces and thus decrease even further the time at which the adhesion forces become less than the net uplift force.

The lower hull 12 is then raised relative to the stabilizing hull 16 by use of the four control means. This will cause the stabilizing hull to sink slightly lower in the water to provide the necessary buoyancy force to counteract the increased net gravitation force of the remainder of the barge due to the loss of buoyancy force caused by the raising of the support column. The jacking up of the lower hull is continued until the lower hull rests immediately below the stabilizing hull 16. The next step is to deballast the remaining tanks in the lower hull 12 to place the entire barge 10 back into the surface-floating mode. The barge 10 can then be towed to the next drilling site. The modes of operation above-described can be summarized as follows:

(1) A transit mode of either surface floating and towing as shown in FIG. 1 or dry transit on the deck of a transport ship.

(2) A submerging and emerging operational mode for bottom founding and barge removal under controlled static stability due to the operation of the stabilizing hull 16.

(3) A bottom-resting gravity platform mode for carrying out drilling operations in a protected environment in arctic areas.

(4) A lateral force resisting mode which depends upon the friction developed between the large area lower hull 12 and the sea floor to resist lateral forces of wind, ice floes, waves, and current.

The above fourth operational mode permits the barge to slide-off of station in an emergency when a collision with an irresistible ice feature occurs or is about to occur. To ensure that sliding will occur, the factor of safety against sliding is smaller than the safety factors used for soil bearing and structural integrity. In addition, by controlled deballasting, the friction force between the lower hull and the sea floor can be substantially reduced, further ensuring the tendency of the barge to slide. Thus, the barge 10 will slide-off station rather than overturn or suffer structural damage. An important operational advantage of this mode is that a drill head 710, such as in FIG. 5, can be retracted when impact by an irresistible ice feature is imminent so that the barge can be slid off from well 712. When conditions permit, the barge can be repositioned for continued operations. Special below mudline, wellhead caissons can be employed for maintaining well integrity for this purpose.

The above-described preferred embodiment of barge 10 has a total variable load capacity of 13,500 short tons excluding the ballast. The variable deckload is 8500 short tons. The barge is designed to have a 270 day endurance which is limited only by the consumables which can be stored aboard. Supplies sufficient for drilling three 12,000 foot wells without replenishment can be provided.

When on a drilling station the drilling tubular or pipes can be operated from the drilling deck down through the inner shell of the support column 18 which serves as a drilling shaft. A column inside diameter of 15 to 20 feet is sufficient for this purpose. The spud-in procedure and installation of the BOP guide base and the BOP itself can be carried out through this drill shaft.

The stabilizing hull 16 performs the following four functions.

(1) It provides static stability during descent and barge removal, i.e. provides intact stability.

(2) It provides buoyancy to the barge to permit controlled bottom founding, and then breakout when a given drilling program has been completed.

(3) The increased weight of ballast which can be placed into the ballast tank when the stabilizing hull has been raised above the mean water surface adds to the net gravitational force to better resist lateral ice loadings.

(4) The use of the stabilizing hull for submerging and emerging results in an increased ease of mobilization for the barge when moving between drilling sites.

The moment of inertia of the water plane area of the preferred lower hull 12 when in the towing transit mode illustrated in FIG. 1 is approximately $2\times10^8$ ft.$^4$ at a 23 foot draft. When the submerging or emerging mode is in effect as shown in FIG. 2, the preferred stabilizing hull 16 provides a moment of inertia of the water plane area of about $100\times10^6$ ft.$^4$ which is sufficient to provide stability for the barge 10 within the environmental operating envelope set forth above.

ILLUSTRATIVE BARGE PROPORTIONS

The above-described preferred embodiment of barge 10 comprises major elements which can be sized within the following dimension and size ranges. The subscript nomenclature of UH for upper hull, COL for column, SH for stabilizing hull, and LH for lower hull has been used throughout. Also the symbol D has been used for diameters on the barge and d for depth of the upper and lower hulls. These ranges depend upon a number of operating variables and among the more important of these are the following:

Variables:

| | |
|---|---|
| E = | required endurance (days) |
| WD = | water depth (ft) |
| MW = | maximum crest elevation above mean sea level of design wave including maximum tidal and storm surge effects (ft) |
| $F_y$ = | yield strength of steel in column (short tons/ft$^2$) |
| $W_I$ = | ice load (short tons/ft) |
| $q_a$ = | allowable soil bearing pressure (short tons/ft$^2$) |
| VL = | variable load (short tons) |
| ≃ | 5000 + 32.2 E (short tons) |

Other variables are defined below as introduced.

Upper Hull 12 Dimensions

The upper hull area is a function of the required endurance for the barge, i.e. the length of time for which it is designed to remain on a particular drilling assignment. The relationship is set forth as follows:

EQUATION 1

$$\text{Upper Hull Area} = A_{UH} \simeq (180 + 3.65\sqrt{E})^2$$

A typical size range is 32,000 to 63,000 square feet. The upper hull depth can have a typical range of 20 to 27 feet and a weight of 10,000 to 17,000 short tons.

Stability or Stabilizing Hull

The stability hull is sized in such a way as to supply the required metacentric radii (BM) which, in turn, will assure sufficient metacentric heights (GM) and righting arms (GZ) at various drafts and through a sufficient range of angles of heel to keep the barge 10 stable under typical design wind, current, and wave conditions.

These conditions should be within the limits of wind of 20 knots, current of 1.5 knots and waves of 5 feet significant wave height.

The following approximate dimensions, weights, and ballast capacity can be used for the stability hull:

Stability Hull Diameter ($D_{SH}$): 150 to 280 feet

Stability Hull Depth ($d_{SH}$): 8 to 15 feet

Stability Hull Weight ($W_{SH}$): 800 to 5500 short tons

Stability Hull Weight ($W_{SH}$) can be approximately determined by the expression:

$$\text{Stability Hull Weight} = W_{SH} \approx 0.00468\, D_{SH}{}^2 d_{SH} \quad \text{EQUATION 2}$$

Stability Hull Ballast ($B_{SH}$) *has a typical range of* 4000 to 27,000 short tons and can be approximately determined by the equation:

$$\text{Stability Hull Ballast} = B_{SH} \approx 0.0227\, D_{SH}{}^2 d_{SH} \quad \text{EQUATION 3}$$

Column Dimensions and Weight

The column 18 can have an approximate height range of 40 to 190 feet. This height ($H_{COL}$) can be approximated by the following expression:

Column Height $$= H_{COL} \geqq WD - d_{LH} + d_{SH} + MW + 5 \quad \text{EQUATION 4}$$

Where, $d_{LH}$ is the depth of the lower hull in feet. The column height is chosen to be effective for permitting both surface floating transit and bottom founded operations in water depths up to about 150 feet.

Column Diameter can have a range of 30 to 50 feet. The column diameter ($D_{COL}$) for column 18 measured in feet must satisfy the following approximate expression:

$$0.8F_y \geqq \frac{(0.0667\sqrt{A_{UH}}\, d_{UH} + 225)(H_{COL} + 64) + W_I D_{COL}(WD - d_{LH}) + 1074E}{0.305\, D_{COL}^2} \quad \text{EQUATION 5}$$

where, $d_{UH}$=depth of the upper hull in feet and the remaining terms are as above defined.

Column Weight ($W_{COL}$) can be in the range of 1500 to 12,000 short tons. An expression from which column weight can be determined is:

$$\text{Column Weight} = W_{COL} \approx 1.22\, D_{COL} H_{COL} \quad \text{EQUATION 6}$$

Lower Hull Dimension and Weight Ranges

The lower hull diameter measured at apexes in the case of a polygonal configuration as shown in FIG. 9 can have an approximate range of 180 to 350 feet. This diameter determination is made by considering a relationship which takes into account the in-place weight of barge 10 including the ballast weight in the lower hull and the stability hull, the variable load on the upper hull and the displacement water mass.

The Lower Hull Depth ($d_{LH}$) can have a range of 15 to 35 feet and should satisfy the expression:

$$D_{LH}/12 \geqq d_{LH} \geqq D_{LH}/9 \quad \text{EQUATION 7}$$

The lower hull weight can have a range of 3500 to 30,000 short tons. An expression for this Lower Hull Weight ($W_{LH}$) is:

$$\text{Lower Hull Weight} = W_{LH} \approx 0.00713\, D_{LH}{}^2 d_{LH} \quad \text{EQUATION 8}$$

The Lower Hull Ballast Weight ($B_{LH}$) can have an approximate range of 8,000 to 70,000 short tons. An expression by which this range may be calculated is:

$$\text{Lower Hull Ballast} = B_{LH} \approx 0.0166\, D_{LH}{}^2 d_{LH} \quad \text{EQUATION 9}$$

Lower hull displacement can have an approximate range of 12,000 to 103,000 short tons. This displacement weight can be determined according to the following expression:

$$\text{Displacement} = \text{Disp} \approx 0.0241\, D_{LH}{}^2 d_{LH} \quad \text{EQUATION 10}$$

The diameter range for the lower hull 12 of 180 to 350 feet set forth above is based on the following approximate relationship in which a safety factor against an overturning moment created by ice and wind forces of 4 has been utilized:

$$D_{LH} \geqq \frac{8[(.0667\sqrt{A_{UH}}\, d_{UH} + 225)(H_{COL} + d_{LH} + 64) + D_{COL} W_I (WD)]}{(IPW - 5000 - 32.2E)} \quad \text{EQUATION 11}$$

wherein, $A_{UH}$=area of the upper hull 28, in ft$^2$;

$d_{UH}$=depth of upper hull 28, in ft ;

$H_{COL}$=height of column 18 in feet;

$D_{COL}$=diameter of column in feet; and

IPW =inplace weight of barge 10 in short tons taking into account all barge weights, ballast weight, variable load, and displacement; and the remaining terms have the above defined meanings.

Assurance of the sliding mode of operation in order to prevent overturning or damage of vessel structure can be maintained by observing the following approximate relationship for coefficient of friction ($\mu_a$) between the sea bed and the bottom of the lower hull 12:

$$\mu_a \geqq \frac{.0667\, A_{UH} d_{UH} + 225 + W_I D_{COL}}{(IPW - 5000 - 32.2E)} \quad \text{EQUATION 12}$$

wherein, the terms have the above-defined meaning.

The more preferred barge dimensions within those set forth in the above ranges for operations in the Beaufort Sea at water depths of about 25 ft to about 80 ft are the following: a square upper hull of 240 feet×240 feet with a 25 foot depth; a stabilizing hull of 210 feet in diameter and 11 feet in depth; a lower hull of 270 feet in diameter, measured at the apexes of the sixteen sided polygon shown in FIG. 9, and a depth of 25 feet; and a cylindrical central support member having a height of 92 feet and an outer diameter of 40 feet. A barge 10 of these preferred dimensions and constructed according to the above preferred embodiment description will have the following metacentric heights at the drafts measured from the bottom of the lower hull as set forth in the following Table 1.

TABLE 1

Metacentric Heights of Barge at Various Drafts

| Mode of Operation | Draft, Ft. | Metacentric Height (GM), Ft. |
|---|---|---|
| Surface floating on lower. hull with 2 ft. of freeboard | 23 | 77 |
| Lower hull submerged and stability hull at 5 ft. draft | 30 | 10.5 |
| Submerged lower hull and stability hull at 10 ft. draft above lower hull top surface | 35 | 10.9 |
| Lower hull being placed into bottom founded position and stability hull at 15 ft. above lower hull top surface | 40 | 11.32 |
| Barge at deepest draft without being bottom founded | 100 | 16.3 |

Table 1 illustrates that the barge 10 has adequate metacentric height at all operating modes.

Accommodations sufficient for a crew of 100 are provided in the upper hull. It can be outfitted to have at least 270 days endurance on drilling station. While the barge can be towed at somewhat deeper drafts, it is preferred to transit the barge at about 20 feet draft.

The above dimension and weight ranges present certain ranges and ratios by which the major elements of the barge 10 can be proportioned. In addition, the ratio of weight of the barge measured in short tons to the diameter of the stabilizing hull in ft. should be within the range of about 110 to 400 s. tons/ft. This ratio is of importance for providing intact stability to the barge while descending to or ascending from the sea floor. Another ratio of interest is of the in-place weight of the barge in short tons to waterline diameter of the support member in feet. This ratio should be within the range of about 500 to 1500 s. tons/ft. and is of importance for providing adequate load on the sea bed to enable the barge to withstand ice forces.

FIG. 11 shows diagrammatically the major forces acting on barge 10 with the moment due to eccentric deckload on the upper hull, $M_{EL}$, and the moments due to the wind and ice forces all acting in the same direction. An ice floe 714 is illustrated in FIG. 5. The wind and ice forces act through effective moment arms which are shown as x and y, respectively. The total moment is:

$$F_{wind} \cdot x + F_{ice} \cdot y + M_{EL}$$

The counteracting moment is developed by the interaction of the bottom surface of the lower hull with the sea floor. The load on the seabed must, on the one hand, be large enough so that the barge is not moved off location by the horizontal environmental forces, and, on the other hand, be small enough so that the allowable soil bearing load is not exceeded.

The maximum soil bearing pressure will occur when the barge is fully ballasted and has the total variable load of 13,500 s. tons on board. In addition, the wind moment and ice moment must be at their maximums, and acting in the same direction together with the eccentric deckload moment.

The minimum soil bearing load will occur when the variable load of 13,500 s. tons is completely depleted. In addition, the wind moment and ice moment must be at their maximums, and acting in the same direction as each other and in the direction of the eccentric moment with no variable load on board. Since a tensile bearing load is not physically possible, and since no lifting of any portion of the lower hull will be permitted to occur; the maximum permissible ice load occurs when the minimum soil bearing pressure equals zero. This results in a factor of safety against overturning of 4.0.

BARGE MODIFICATIONS

Figure 12:
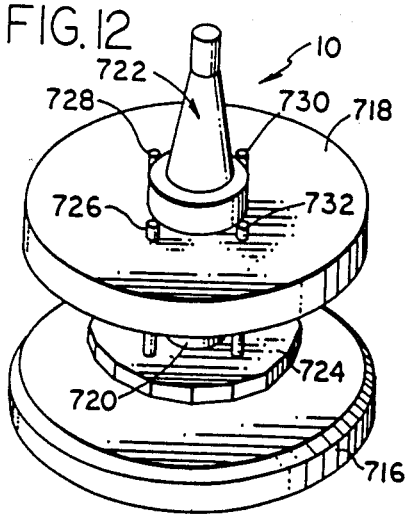
FIGS. 12, 13, and 14 are schematic perspective and plan views of variations of the barge of the present invention.

FIG. 12 shows that barge 10 can be constructed of major elements having different shapes and proportions than those illustrated in FIGS. 1–9, above. A circular shaped lower hull 716 is connected to a circular shaped upper hull 718 by a support member 720 and a derrick enclosure 722 is provided on the upper surface of this schematic diagram. A sixteen-sided polygonal stabilizing hull 724 is connected to the upper hull 718 by four jacking legs 726, 728, 730, and 732. These jacking legs are operated by jacking units mounted within the upper hull 718 to complete the control means for moving the stabilizing hull 724 relative to the upper hull 718. A large lower hull of cylindrical shape, such as shown in FIG. 12, is somewhat more difficult to fabricate than the sixteen sided lower hull shown in FIGS. 1–9. It does, however offer certain advantages in the surface-floating mode for more controlled towing and by way of lower resistance to subsurface currents. The chief advantage of the circular upper hull 718 is that the overturning moment due to the wind force is the same in all directions, and it is this force which has the largest moment arm, as shown by FIG. 11.

Figure 13:
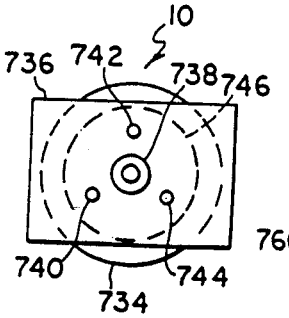

FIG. 13 shows another modification of barge 10 wherein a circular lower hull 734 has a rectangular upper hull 736 spaced therefrom by a cylindrical support member 738. In this modification three jacking legs 740, 742, and 744 are provided for connecting the upper hull 736 with the circular stabilizing hull 746. The derrick enclosure has been removed for clarity.

Thus, either three or four jacking legs can be employed as shown in FIGS. 1—13. A larger number of jacking legs appears to raise construction costs without sufficient offsetting operational advantages, although a large number of jacking legs could be employed for whatever reason deemed sufficient.

Figure 14:
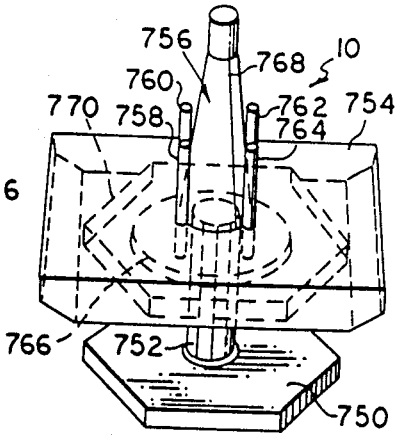

FIG. 14 shows a barge 10 with a hexagonal lower hull 750 connected to an octagonal outer-surfaced support member 752 which adjustably connects with a barge-shaped upper hull 754 which is generally rectangular in shape. A derrick enclosure 756 is provided on the top surface of upper hull 754. Four jacking legs 758, 760, 762, and 764 are shown supported by the upper hull 754. Jacking units are provided for direct contact with the jacking legs as in FIGS. 1–9. A circular shaped stabilizing hull 766 is connected to the four jacking legs for the purposes above-described with respect to stabilizing hull 16 of FIGS. 1–9. In this modification, the derrick enclosure 756 is constructed of a removable series of panels shown generally by division line 768 and the connection between the upper hull 754 and support member 752 is constructed to be adjustable whereby the upper hull 754 can be collapsed downwardly upon the lower hull 750 by a series of heavy duty column jacking units which operate in conjunction with jacking tracks formed by a series of vertical openings in the support member. In this manner, the entire barge 10 can be towed to a drilling site using the barge shaped upper hull 754 as the transit hull for the floating mode. The lower hull 750 can then be taken into a floating semisubmerged mode by deballasting the lower hull 750 to the point where it has only a small net gravitational force exerted thereby. The buoyancy force which is available from the stabilizing hull 766 can then be employed to float the upper hull 754 above the surface of the water. In this modification, the barge 10 can be moved a short distance into a drilling site and then the bottom-founding procedures set forth in the mode of operation section, above, with respect to FIGS. 1–9 carried out in exactly the same manner. The principle distinction between the barge modification in FIG. 14 and those in FIGS. 1–13 is that the support member 752 can be adjusted to control the distance of separation between the upper and lower hulls in order to provide for a more mobile transit configuration.

The hexagonal lower hull 750, octagonal surfaced support member 752 and the barge shaped upper hull 754 can, of course, be utilized for the same modification of barge in which there is no adjustment between the support member 752 and the upper hull 754 and thus no need for recess 770. The eight-sided support member 752 can be used. Any number of sides greater than two can be used for a flat-sided support column.

It is not necessary that the central support member have a vertically straight exterior surface. It may be of a conical or a multi-sided pyramid shape. In addition, these various shapes may be used for different levels of the support member and vertically curved as well as vertically sloping shapes can be used. For example, the lower portion of the central member may be the frustum of a cone and the upper portion a cylinder, or the lower portion could be a frustum of an eight-sided pyramid and the upper portion an eight-sided prism. If it were desirable, a multi-sided prism could be attached to a frustum of a cone, or a cylinder could be attached to the frustum of a multi-sided pyramid, or multi-sided prism could be attached to the frustum of a pyramid with a different number of sides than the prism. A straight-sided exterior surface for the central support member is required to be used where the stabilizing hull is designed to transmit horizontal forces directly to the support column. The various shapes, types, and proportional sizes of the major elements of the barge shown in FIGS. 1–14 and described above can be used interchangeably.

ICE FAILURE OPERATION

Figure 15:
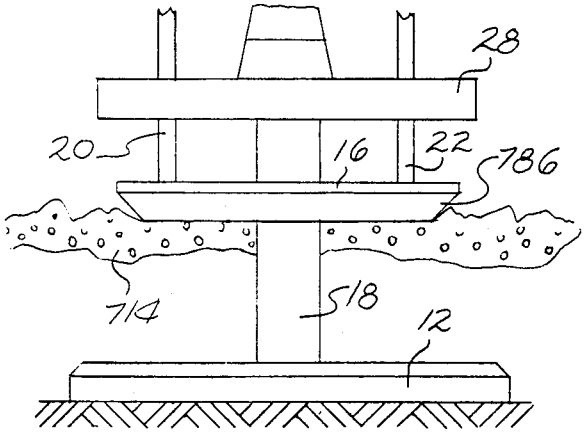
FIG. 15 is a view similar to that of FIG. 5 showing the stability hull lowered into contact with an ice floe for failing ice features.
Figure 16:
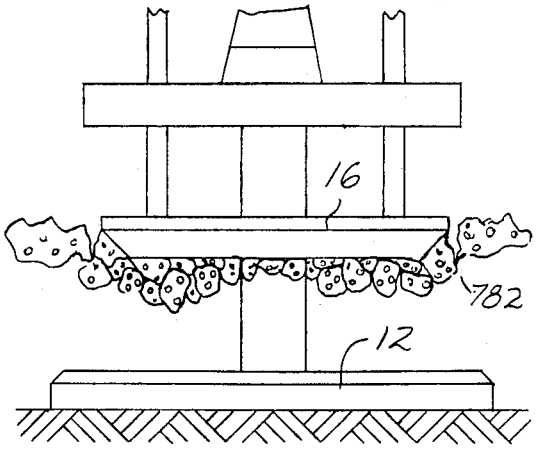
FIG. 16 is a view similar to that of FIG. 15 showing the stability hull after penetration of an ice floe.

The intermediate hull 16 may be used in another operational mode for failing ice features. One such method is illustrated in FIGS. 15 and 16. In FIG. 15, floating ice 714 has moved into the area between the lower hull 12 and the upper hull 28. The intermediate hull 16 is moved downward from its normal position adjacent the upper hull 28, into engagement with the ice 714. Downward movement of the stabilizing hull is continued to exert a downward pressure on the ice for failing the ice by breaking that portion of the ice under the stabilizing hull. In FIG. 16, the hull 16 is shown as having moved through the ice floe, with the broken ice 782 around and below the hull. This mode of operation provides an active means of failing or breaking ice after the barge is in the bottom-resting mode.

Figure 17:
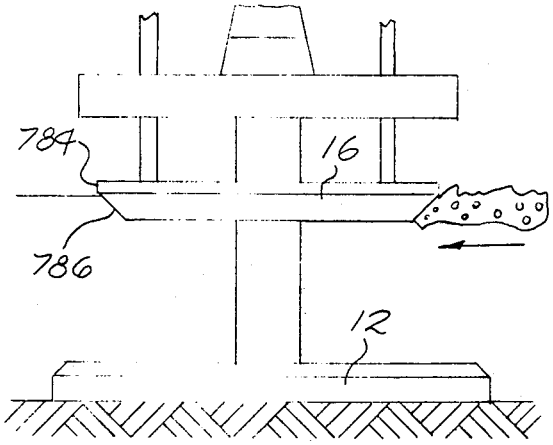
FIG. 17 is a view similar to that of FIG. 5 showing the stability hull positioned at the water line for engaging and failing ice features in flexure.
Figure 18:
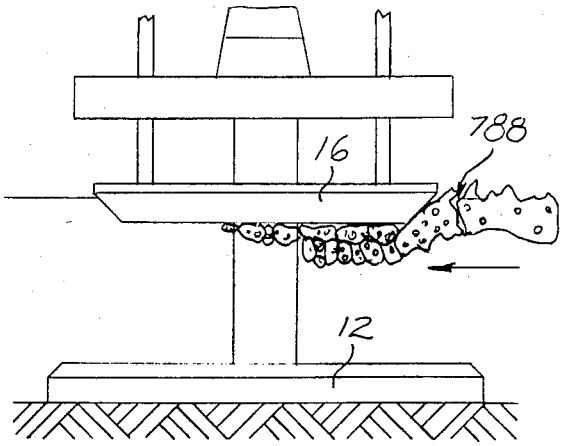
FIG. 18 is a view similar to that of FIG. 17 showing the break up of an ice floe in flexure.

An alternative method of operation for failing ice features is shown in FIGS. 17 and 18. In this embodiment, the outer edge 784 of the stabilizing hull 16 preferably has a sloped surface 786. This sloped surface preferably is provided around the entire periphery of the stabilizing hull and preferably converges in a downward direction. When the stabilizing hull is circular in plan, the surface will have a frusto-conical shape.

In operation, the stabilizing hull 16 is positioned adjacent the waterline so that an ice floe 714 will engage the sloped surface 786, with the lateral movement of the ice floe causing flexure of the ice and hence failure of the ice feature in flexure, as indicated at 788 in FIG. 18.

The ice failing capability of the barge, as illustrated in FIGS. 15–18, permit the barge to operate in greater water depths, such as about 300 feet.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

We claim:

1. A mobile barge having both surface-floating and bottom resting modes of operation and comprising:

a lower hull having sufficient buoyancy to permit said barge to have a surface-floating mode and having a bottom surface adapted for providing gravity-forced contacting support from the sea floor when said barge is in the bottom-resting mode;

an upper hull containing equipment for conducting barge operating functions;

a vertically positioned support means for supporting said upper hull, with said support means mounted in and extending above said lower hull, and with said upper hull fixed to said support means maintaining a fixed separation between said upper and lower hulls;

a stabilizing hull arranged about said support means and adapted for controlled movement between said lower hull and said upper hull; and control means for providing motive force for moving said stabilizing hull vertically between said upper and lower hulls and for transmitting force between said stabilizing hull and the remainder of said barge, with said stabilizing hull adapted to provide controlled downward pressure on ice located between said stabilizing hull and said lower hull while said barge is maintained in the bottom-resting operational mode.

2. A mobile barge according to claim 1, wherein said control means comprises a plurality of jacking legs connected to one of said upper and lower hulls and a motive means for moving said legs relative to said hulls and wherein said control means is adapted to move said stabilizing hull to selected vertical positions between said upper and lower hulls.

3. A mobile barge according to claim 2, wherein said stabilizing hull is connected to said upper hull by said jacking legs.

4. A mobile barge according to claim 2, wherein said stabilizing hull is connected to said lower hull by said jacking legs and wherein said motive means is supported by said stabilizing hull.

5. A mobile barge according to claim 1, wherein the motive force provided by said control means is primarily compressive force acting between said stabilizing hull and the remainder of said barge.

6. A mobile barge according to claim 1, wherein said stabilizing hull is connected to said upper hull by four jacking legs, and said control means is adapted to move said stabilizing hull to various positions between said upper and lower hulls.

7. A mobile barge according to claim 1, wherein the ratio of weight of said barge in short tons to the diameter of said stabilizing hull in feet is within the range of about 110 to 400 short tons/ft.

8. A mobile barge according to claim 1 or 7, wherein the ratio of the in-place weight of said barge in short tons to the waterline diameter of said support member in feet is within the range of about 500 to 1500 short tons/ft.

9. A mobile barge according to claim 1, wherein said stabilizing hull has an outer edge, with said edge having a sloped surface for positioning adjacent the waterline for engaging ice floes for failing ice floes in flexure.

10. A mobile barge according to claim 1, wherein said stabilizing hull has an outer edge having a sloped surface of frusto-conical shape with the apex downward.

11. A mobile barge having both surface-floating and bottom-resting modes of operation and comprising:

a lower hull having sufficient buoyancy to permit said barge to have a surface floating mode and having a bottom surface adapted for providing gravity-forced contacting support from the sea floor when said barge is in said bottom-resting mode;

an upper hull containing equipment for conducting barge operating functions;

support means comprising a single central column for supporting said upper hull from said lower hull, with said upper and lower hulls fixed to upper and lower end portions of said upport means, respectively, to maintain a fixed separation between said upper and lower hulls; and control means for providing motive force to enable movement of said stabilizing hull with respect to said upper hull and for transmitting force from said stabilizing hull to the remainder of said barge, with said stabilizing hull continuously movable vertically between said upper and lower hulls to position and maintain said stabilizing hull at the water line for various depths of submergence of said lower hull and to position said stabilizing hull out of the water while said lower hull is in the bottom-resting mode;

with said control means comprised of a plurality of jacking legs connected between said upper hull and said stabilizing hull and a motive means for moving said legs relative to said upper hull, and with said stabilizing hull having an outer edge, with said edge having a sloped surface for positioning adjacent the waterline for engaging ice floes for failing floes in flexure; and with said control means adapted for providing motive force for moving said stabilizing hull downward to provide controlled downward pressure on ice located between said stabilizing hull and said bottom hull while said barge is maintained in the bottom-resting mode.

12. A mobile barge according to claim 11, wherein the motive force provided by said control means is primarily compressive force acting between said stabilizing hull and said upper hull.

13. A mobile barge according to claim 11, wherein said control means are adapted to exert compressive force on said jacking legs to submerge said lower hull and the bottom portion of said support means downward below the mean waterline and to establish controlled contact between said lower hull and the sea floor.

14. A mobile barge according to claim 11, wherein said motive means consists of jacking devices secured to said upper hull which are adapted for jacking engagement with respect to said jacking legs.

15. A mobile barge according to claim 11, wherein the ratio of weight of said barge in short tons to the diameter of said stabilizing hull in feet is within the range of about 110 to 400 short tons/ft.

16. A mobile barge according to claim 11 or 15, wherein the ratio of the in-place weight of said barge in short tons to the waterline diameter of said support member in feet is within the range of about 500 to 1500 tons/ft.

17. A mobile barge according to claim 11, wherein said stabilizing hull outer edge sloped surface converges in a downward direction.

18. A method of failing ice features about a mobile barge having a unitary lower hull provided with sufficient buoyancy to permit the barge to have a surface-floating mode, a support member extending above the lower hull, an upper hull positioned at the top portion of the support member, and a stabilizing hull arranged about the support member, which stabilizing hull is adapted for controlled movement between a position adjacent to the top portion of the lower hull and a position adjacent to the bottom portion of the upper hull, and having a control means for moving the stabilizing hull relative to the upper hull, including the steps of:

lowering the lower hull onto the sea floor while simultaneously submerging portions of said support member and maintaining said stabilizing hull partly submerged;

raising the stabilizing hull above ice adjacent the barge; and lowering the stabilizing hull applying downward pressure on ice between the stabilizing hull and the lower hull.

19. A method according to claim 18, wherein said lowering step is performed by jacking the stabilizing hull relative to the remainder of the barge.

20. A method according to claim 19, wherein said jacking is carried out between the jacking legs connected to the stabilizing hull and control means associated with the upper hull.

* * * * *